US008305307B2

(12) United States Patent
Ono

(10) Patent No.: US 8,305,307 B2
(45) Date of Patent: Nov. 6, 2012

(54) DISPLAY DEVICE AND METHOD OF DRIVING THE SAME

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/421,948

(22) Filed: Mar. 16, 2012

(65) Prior Publication Data

US 2012/0169799 A1 Jul. 5, 2012

Related U.S. Application Data

(63) Continuation of application No. PCT/JP2010/005454, filed on Sep. 6, 2010.

(51) Int. Cl.
*G09G 3/30* (2006.01)

(52) U.S. Cl. ..... 345/76

(58) Field of Classification Search ..... 345/76, 345/77, 82, 90, 92, 103, 204, 211, 690; 315/169.3
See application file for complete search history.

(56) References Cited

U.S. PATENT DOCUMENTS

| | | | |
|---|---|---|---|
| 8,054,298 | B2 | 11/2011 | Asano et al. |
| 8,164,546 | B2 | 4/2012 | Odawara et al. |
| 2008/0291182 | A1 | 11/2008 | Yamashita et al. |
| 2009/0122047 | A1 | 5/2009 | Yamamoto et al. |
| 2009/0244055 | A1 | 10/2009 | Asano et al. |
| 2010/0007645 | A1 | 1/2010 | Ono |
| 2010/0109985 | A1 | 5/2010 | Ono |
| 2011/0181192 | A1 | 7/2011 | Ono |
| 2012/0062618 | A1 | 3/2012 | Ono |

FOREIGN PATENT DOCUMENTS

| | | |
|---|---|---|
| JP | 2003-186439 | 7/2003 |
| JP | 2003-195809 | 7/2003 |
| JP | 2008-122633 | 5/2008 |
| JP | 2008-287141 | 11/2008 |
| JP | 2009-139928 | 6/2009 |
| JP | 2009-237041 | 10/2009 |
| JP | 2010-054564 | 3/2010 |
| WO | 2008/152817 | 12/2008 |
| WO | 2009/011092 | 1/2009 |
| WO | 2010/100938 | 9/2010 |

*Primary Examiner* — Regina Liang
(74) *Attorney, Agent, or Firm* — Greenblum & Bernstein, P.L.C.

(57) ABSTRACT

The display device including pixels has formed therein at least two drive blocks each made up of pixel rows. Each of the pixels includes: a drive transistor; a first capacitor element, a luminescence element; a first switching transistor which causes conduction between the drive transistor and the first capacitor element; and a second switching transistor which applies power supply voltage to the drive transistor. Each of the pixels further includes: a third switching transistor connecting a pixel in a k-th drive block and a first signal line; or a fourth switching transistor connecting a pixel in a (k+1)-th drive block and a second signal line. A first control line for controlling conduction of the first switching transistor and a third control line for establishing a source potential of the drive transistor are connected to each of the pixels in a same one of the drive blocks.

9 Claims, 17 Drawing Sheets

Pixel in odd block

Pixel in odd block

Pixel in even block

Pixel in odd block

Pixel in even block

DISPLAY DEVICE AND METHOD OF DRIVING THE SAME

CROSS REFERENCE TO RELATED APPLICATION

This is a continuation application of PCT Patent Application No. PCT/JP2010/005454 filed on Sep. 6, 2010, designating the United States of America. The entire disclosure of the above-identified application, including the specification, drawings and claims is incorporated herein by reference in its entirety.

BACKGROUND OF THE INVENTION (1) Field of the Invention

The present invention relates to display devices and methods of driving the same, and particularly to a display device using current-driven luminescence elements, and a method of driving the same.

(2) Description of the Related Art

Display devices using organic electroluminescence (EL) elements are well-known as display devices using current-driven luminescence elements. An organic EL display device using such self-luminous organic EL elements does not require backlights needed in a liquid crystal display device and is best suited for increasing device thinness. Furthermore, since viewing angle is not restricted, practical application as a next-generation display device is expected. Furthermore, the organic EL elements used in the organic EL display device are different from liquid crystal cells which are controlled according to the voltage applied thereto, in that the luminance of the respective luminescence elements is controlled according to the value of the current flowing thereto.

In the organic EL display device, the organic EL elements included in the pixels are normally arranged in rows and columns. In an organic EL display referred to as a passive-matrix organic EL display, an organic EL element is provided at each crosspoint between row electrodes (scanning lines) and column electrodes (data lines), and such organic EL elements are driven by applying a voltage equivalent to a data signal, between a selected row electrode and the column electrodes.

On the other hand, in an organic EL display device referred to as an active-matrix organic EL display device, a switching thin film transistor (TFT) is provided in each crosspoint between scanning lines and data lines, the gate of a drive element is connected to the switching TFT, the switching TFT is turned ON through a selected scanning line so as to input a data signal from a signal line to the drive element, and an organic EL element is driven by such drive element.

Unlike in the passive-matrix organic EL display device where, only during the period in which each of the row electrodes (scanning lines) is selected, does the organic EL element connected to the selected row electrode generate photons, in the active-matrix organic EL display device, it is possible to cause the organic EL element to generate photons until a subsequent scan (selection), and thus a reduction in display luminance is not incurred even when the duty ratio increases. Therefore, the active-matrix organic EL display device can be driven with low voltage and thus allows for reduced power consumption. However, in the active-matrix organic EL display device, due to variation in the characteristics of the drive transistors, the luminance of the organic EL elements are different among the respective pixels even when the same data signal is supplied, and thus there is the disadvantage of the occurrence of luminance unevenness.

In response to this problem, for example, Japanese Unexamined Patent Application Publication No. 2008-122633 (Patent Reference 1) discloses a method of compensating for the variation of characteristics for each pixel using a simple pixel circuit, as a method of compensating for the luminance unevenness caused by the variation in the characteristics of the drive transistors.

FIG. 13 is a block diagram showing the configuration of a conventional image display device disclosed in Patent Reference 1. An image display device 500 shown in the figure includes a pixel array unit 502 and a drive unit which drives the pixel array unit 502. The pixel array unit 502 includes scanning lines 701 to 70*m* disposed on a row basis, and signal lines 601 to 60*n* disposed on a column basis, pixels 501 each of which is disposed on a part at which both a scanning line and a signal line cross, and power supply lines 801 to 80*m* disposed on a row basis. Furthermore, the drive unit includes a signal selector 503, a scanning line drive unit 504, and a power supply line drive unit 505.

The scanning line drive unit 504 performs line-sequential scanning of the pixels 501 on a per row basis, by sequentially supplying control signals on a horizontal cycle (1 H) to each of the scanning lines 701 to 70*m*. The power supply line drive unit 505 supplies, to each of the power supply lines 801 to 80*m*, power source voltage that switches between a first voltage and a second voltage, in accordance with the line-sequential scanning. The signal selector 503 supplies, to the signal lines 601 to 60*n* that are in columns, a reference voltage and a luminance signal voltage which serves as an image signal, switching between the two voltages in accordance with the line-sequential scanning.

Here, two each of the respective signal lines 601 to 60*n* in columns are disposed per column; one of the signal lines supplies the reference voltage and the signal voltage to the pixels 501 in an odd row, and the other of the signal lines supplies the reference voltage and the signal voltage to the pixels 501 in an even row.

FIG. 14 is a circuit configuration diagram for a pixel included in the conventional image display device disclosed in Patent Reference 1. It should be noted that the figure shows the pixel 501 in the first row and the first column. The scanning line 701, the power supply line 801, and the signal lines 601 are provided to this pixel 501. It should be noted that one out of the two lines of the signal lines 601 is connected to this pixel 501. The pixel 501 includes a switching transistor 511, a drive transistor 512, a storing capacitor 513, and a luminescence element 514. The switching transistor 511 has a gate connected to the scanning line 701, one of a source and a drain connected to the signal line 601, and the other connected to the gate of the drive transistor 512. The drive transistor 512 has a source connected to the anode of the luminescence element 514 and a drain connected to the power supply line 801. The luminescence element 514 has a cathode connected to a grounding line 515. The storing capacitor 513 is connected to the source and gate of the drive transistor 512.

In the above-described configuration, the power supply line drive unit 505 switches the voltage of the power supply line 801, from a first voltage (high-voltage) to a second voltage (low-voltage), when the voltage of the signal line 601 is the reference voltage. Likewise, when the voltage of the signal line 601 is the reference voltage, the scanning line drive unit 504 sets the voltage of the scanning line 701 to an "H" level and causes the switching transistor 511 to be in a conductive state so as to apply the reference voltage to the gate of the drive transistor 512 and set the source of the drive transistor 512 to the second voltage. With the above-described operation, preparation for the correction of a threshold voltage Vth of the drive transistor 512 is completed. Next, in the correction period before the voltage of the signal line 601 switches from the reference voltage to the signal voltage, the power supply line drive unit 505 switches the voltage of the power supply line 801, from the second voltage to the first voltage, and causes a voltage equivalent to the threshold voltage Vth of the drive transistor 512 to be stored in the storing capacitor 513. Next, the power supply line drive unit 505 sets the voltage of the switching transistor 511 to the "H" level and causes the signal voltage to be stored in the storing capacitor 513. Specifically, the signal voltage is added to the previously stored voltage equivalent to the threshold voltage Vth of the drive transistor 512, and stored into the storing capacitor 513. Then, the drive transistor 512 receives a supply of current from the power supply line 801 to which the first voltage is being applied, and supplies the luminescence element 514 with a drive current corresponding to the stored voltage.

In the above-described operation, the period of time during which the reference voltage is applied to the respective signal lines is prolonged through the placement of two of the signal lines 601 in every column. This secures the correction period for storing the voltage equivalent to the threshold voltage Vth of the drive transistor 512 in the storing capacitor 513.

FIG. 15 is an operation timing chart for the image display device disclosed in Patent Reference 1. The figure describes, sequentially from the top, the signal waveforms of: the scanning line 701 and the power supply line 801 of the first line; the scanning line 702 and the power supply line 802 of the second line; the scanning line 703 and the power supply line 803 of the third line; the signal line allocated to the pixel of an odd row; and the signal line allocated to the pixel of an even row. The scanning signal applied to the scanning lines sequentially shifts 1 line for every 1 horizontal period (1 H). The scanning signal applied to the scanning lines for one line includes two pulses. The time width of the first pulse is long at 1 H or more. The time width of the second pulse is narrow and is part of 1 H. The first pulse corresponds to the above-described threshold voltage correction period, and the second pulse corresponds to a signal voltage sampling period and a mobility correction period. Furthermore, the power source pulse supplied to the power supply lines also shifts 1 line for every 1 H cycle. In contrast, the signal voltage is applied once every 2 H to the respective signal lines, and thus it is possible to ensure that the period of time during which the reference voltage is applied is 1 H or more.

In this manner, in the conventional image display device disclosed in Patent Reference 1, even when there is a variation in the threshold voltage Vth of the drive transistor 512 for each pixel, by ensuring a sufficient threshold voltage correction period, the variation is canceled on a pixel basis, and unevenness in the luminance of an image is inhibited.

SUMMARY OF THE INVENTION

However, in the conventional image display device disclosed in Patent Reference 1, there is frequent turning ON and OFF of the signal level of the scanning lines and power supply lines provided to each of the pixel rows. For example, the threshold voltage correction period needs to be set for each of the pixel rows. Furthermore, when sampling luminance signal voltage from a signal line via a switching transistor, luminescence production (photon generation) periods need to be provided successively. Therefore, the threshold voltage correction timing and luminescence production timing for each pixel row needs to be set. As such, since the number of rows increases with an increase in the area of a display panel, the signals outputted from each drive circuit increases and the frequency for the signal switching thereof rises, and the signal output load of the scanning line drive circuit and the power supply line drive circuit increases.

Furthermore, in the conventional image display device disclosed in Patent Reference 1, the correction period for the threshold voltage Vth of the drive transistor is under 2 H, and thus there is a limitation for a display device in which high-precision correction is required.

In view of the aforementioned problem, the present invention has as an object to provide a display device having decreased drive circuit output load and improved display quality due to high-precision threshold voltage correction.

In order to achieve the aforementioned object, the display device according to an aspect of the present invention is a display device including pixels arranged in rows and columns, the display device including: a first signal line and a second signal line which are disposed in each of the columns, for supplying the pixels with a signal voltage that determines luminance of the pixels; a first power source line and a second power source line; a scanning line disposed in each of the rows; and a first control line, a second control line, and a third control line which are disposed in each of the rows, wherein the pixels compose at least two driving blocks each of which includes at least two of the rows, each of the pixels includes: a luminescence element that includes terminals, one of the terminals being connected to the second power source line, the luminescence element generating photons according to a flow of a signal current corresponding to the signal voltage; a drive transistor that includes a source and a drain and converts the signal voltage applied between a gate and the source of the drive transistor into the signal current, one of the source and the drain being connected to the other of the terminals of the luminescence element; a first capacitor element that includes terminals, one of the terminals being connected to the gate of the drive transistor; a second capacitor element that includes terminals, one of the terminals being connected to the other of the terminals of the first capacitor element and the other of the terminals being connected to the third control line; a first switching transistor that includes a gate connected to the first control line, one of a source and a drain connected to the other terminal of the first capacitor element, and the other of the source and the drain connected to the source of the drive transistor; and a second switching transistor that includes a gate connected to the second control line, and a source and a drain which are inserted between the first power source line and the other of the source and the drain of the drive transistor, each of the pixels in a k-th drive block of the drive blocks further includes a third switching transistor that includes a gate connected to the scanning line, one of a source and drain connected to the gate of the drive transistor, and the other of the source and the drain connected to the first signal line, k being a positive integer, each of the pixels in a (k+1)-th drive block of the drive blocks further includes a fourth switching transistor that includes a gate connected to the scanning line, one of a source and a drain connected to the gate of the drive transistor, and the other of the source and the drain connected to the second signal line, and the first control line and the third control line are connected to the pixels in a same one of the drive blocks and not connected to the pixels in different ones of the drive blocks.

According to the display device and the method of driving the same according to the present invention, the drive transistor threshold voltage correction periods as well as the timings thereof can be made uniform within a drive block, and thus the number of times that the signal level is switched from ON to OFF and from OFF to ON can be reduced and thus reducing the load on the drive circuit which drives the respective circuits of the pixels. In addition, through the above-described forming of drive blocks and the two signal lines provided for each pixel column, the drive transistor threshold voltage correction period can take a large part of a 1-frame period, and thus a highly precise drive current flows to the luminescence elements and image display quality improves.

BRIEF DESCRIPTION OF THE DRAWINGS

These and other objects, advantages and features of the invention will become apparent from the following description thereof taken in conjunction with the accompanying drawings that illustrate a specific embodiment of the present invention. In the Drawings:

FIG. 2 B is a specific circuit configuration diagram of a pixel of an even drive block in the display device according to the first embodiment of the present invention;

DESCRIPTION OF THE PREFERRED EMBODIMENTS

Figure 1:
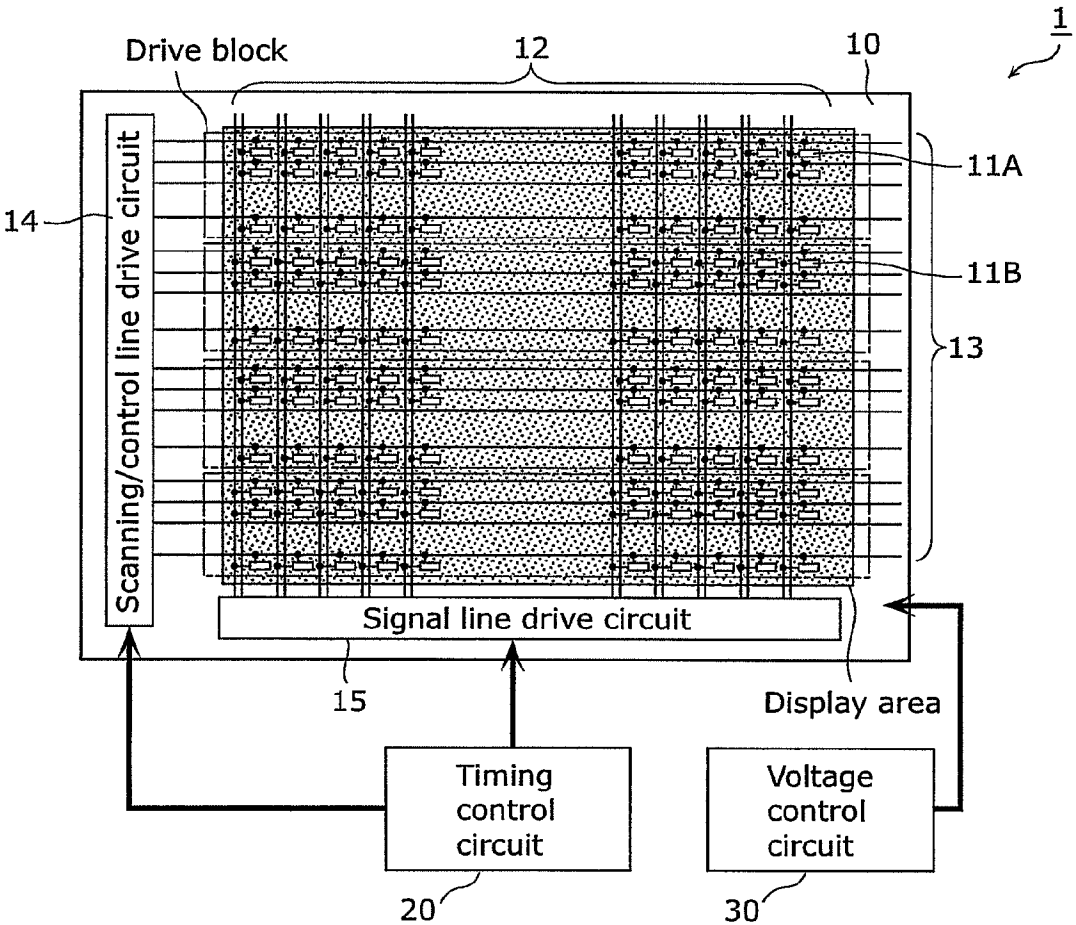
FIG. 1 is a block diagram showing the electrical configuration of a display device according to a first embodiment of the present invention.

In order to achieve the aforementioned object, the display device according to an aspect of the present invention is a display device including pixels arranged in rows and columns, the display device including: a first signal line and a second signal line which are disposed in each of the columns, for supplying the pixels with a signal voltage that determines luminance of the pixels; a first power source line and a second power source line; a scanning line disposed in each of the rows; and a first control line, a second control line, and a third control line which are disposed in each of the rows, wherein the pixels compose at least two driving blocks each of which includes at least two of the rows, each of the pixels includes: a luminescence element that includes terminals, one of the terminals being connected to the second power source line, the luminescence element generating photons according to a flow of a signal current corresponding to the signal voltage; a drive transistor that includes a source and a drain and converts the signal voltage applied between a gate and the source of the drive transistor into the signal current, one of the source and the drain being connected to the other of the terminals of the luminescence element; a first capacitor element that includes terminals, one of the terminals being connected to the gate of the drive transistor; a second capacitor element that includes terminals, one of the terminals being connected to the other of the terminals of the first capacitor element and the other of the terminals being connected to the third control line; a first switching transistor that includes a gate connected to the first control line, one of a source and a drain connected to the other terminal of the first capacitor element, and the other of the source and the drain connected to the source of the drive transistor; and a second switching transistor that includes a gate connected to the second control line, and a source and a drain which are inserted between the first power source line and the other of the source and the drain of the drive transistor, each of the pixels in a k-th drive block of the drive blocks further includes a third switching transistor that includes a gate connected to the scanning line, one of a source and drain connected to the gate of the drive transistor, and the other of the source and the drain connected to the first signal line, k being a positive integer, each of the pixels in a (k+1)-th drive block of the drive blocks further includes a fourth switching transistor that includes a gate connected to the scanning line, one of a source and a drain connected to the gate of the drive transistor, and the other of the source and the drain connected to the second signal line, and the first control line and the third control line are connected to the pixels in a same one of the drive blocks and not connected to the pixels in different ones of the drive blocks.

According to this aspect, the drive transistor threshold voltage correction period and the timing thereof can be made uniform within the same drive block by way of (i) a pixel circuit provided with: a first switching transistor which connects the first capacitor element and the source of the drive transistor; a second switching transistor for supplying power source voltage to the drive transistor; a first capacitor element for storing voltages corresponding to the threshold voltage of the drive transistor and the luminance signal voltage; and a second capacitor element for causing the generation of a voltage for detecting and storing the threshold voltage of the drive transistor in the first capacitor element, and (ii) the arrangement of control lines, scanning lines, and signal lines to the respective pixels which are grouped into drive blocks. Therefore, the load on the drive circuit which outputs signals for controlling current paths, and controls signal voltages is decreased. In addition, through the above-described forming of drive blocks and the two signal lines arranged for every pixel column, the drive transistor threshold voltage correction period can take a large part of a 1 frame period Tf which is the time in which all the pixels are refreshed. This is because the threshold voltage correction period is provided in the (k+1)-th drive block in the period in which the luminance signal is sampled in the k-th drive block. Therefore, the threshold voltage correction period is not divided on a per pixel row basis, but is divided on a per drive block basis. Therefore, as the display area is increased, a long relative threshold voltage correction period can be set with respect to 1 frame period, without allowing luminescence duty to decrease with the increase in the display area. With this, a drive current based on luminance signal voltage that has been corrected with a high degree of precision flows to the luminescence elements, and thus image display quality improves.

Furthermore, in a image display device according to an aspect of the present invention, the second control line may be connected to the pixels in a same one of the drive blocks and not connected to the pixels in different ones of the drive blocks.

According to this aspect, by controlling the second switching transistor for supplying the power source voltage to the drive transistor, simultaneously within the same block using the second control line, simultaneous generation of photons within the same block can be realized, and in addition, the number of outputs of the drive circuit which outputs signals to the second control line can be reduced, and thus the size of the drive circuit can be reduced.

Furthermore, a display device according to an aspect of the present invention further includes a drive circuit which drives each of the pixels by controlling the first signal line, the second signal line, the first control line, the second control line, the third control line, and the scanning line, wherein the drive circuit: stops applying a power source voltage to the drive transistor of each of the pixels in the k-th drive block by turning OFF the second switching transistor using a control signal from the second control line; simultaneously applies a reference voltage from the first signal line to the gate of the drive transistor of each of the pixels in the k-th drive block by turning ON the third switching transistor using a scanning signal from the scanning line; simultaneously applies an initializing voltage to the source of the drive transistor of each of the pixels in the k-th drive block by causing a voltage level of the third control line to change in a state in which the first switching transistor is ON, the initializing voltage causing a gate-source voltage of the drive transistor to be equal to or higher than a threshold voltage; simultaneously causes non-conduction between the first signal line and the gate of the drive transistor of each of the pixels in the k-th drive block by turning OFF the third switching transistor using a scanning signal from the scanning line; stops applying the power source voltage to the drive transistor of each of the pixels in the (k+1)-th drive block by turning OFF the second switching transistor using a control signal from the second control line; simultaneously applies the reference voltage from the second signal line to the gate of the drive transistor of each of the pixels in the (k+1)-th drive block by turning ON the fourth switching transistor using a scanning signal from the scanning line; simultaneously applies the initializing voltage to the source of the drive transistor of each of the pixels in the (k+1)-th drive block by causing a voltage level of the third control line to change in a state in which the first switching transistor is ON; and simultaneously causes non-conduction between the second signal line and the gate of the drive transistor of each of the pixels in the (k+1)-th drive block by turning OFF the fourth switching transistor using a scanning signal from the scanning line.

According to this aspect, the drive circuit which controls the voltage of the first signal line, the second signal line, the first control line, the second control line, the third control line, and the scanning line, controls the threshold voltage correction period, the signal voltage storing period, and the luminescence production (photon generation) period.

Furthermore, in an image display device according to an aspect of the present invention, the signal voltage includes a luminance signal voltage for causing the luminescence element to generate photons and a reference voltage for causing a voltage corresponding to a threshold voltage of the drive transistor to be stored in the first capacitor element, the display device further includes: a signal line drive circuit that outputs the signal voltage to the first signal line and the second signal line; and a timing control circuit that controls the timing at which the signal line drive circuit outputs the signal voltage, and the timing control circuit (i) causes the signal line drive circuit to output the reference voltage to the second signal line when the signal line drive circuit is outputting the luminance signal voltage to the first signal line, and (ii) causes the signal line drive circuit to output the reference voltage to the first signal line when the signal line drive circuit is outputting the luminance signal voltage to the second signal line According to the present aspect, the threshold voltage correction period is provided in the (k+1)-th drive block, in the period in which the luminance signal is sampled in the k-th drive block. Therefore, the threshold voltage correction period is not divided on a per pixel row basis, but is divided on a per drive block basis. Therefore, a longer relative threshold voltage correction period can be set as the display area is increased.

Furthermore, in a display device according to an aspect of the present invention, where a period of time for refreshing all of the pixels is Tf, and a total number of the drive blocks is N, a period of time for detecting a threshold voltage of the drive transistor is at most Tf/N.

Furthermore, the present invention can be implemented, not only as a display device including such characteristic units, but also as display device driving method having the characteristic units included in the display device as steps.

(First Embodiment)

A display device according to the present embodiment is a display device including pixels arranged in rows and columns, the display device including: a first signal line and a second signal line which are disposed in each of the columns; and a first control line, a second control line, and a third control line which are disposed in each of the rows, wherein the pixels compose at least two driving blocks each of which includes at least two of the rows, each of the pixels includes: a drive transistor; a first capacitor element that includes terminals, one of the terminals being connected to a gate of the drive transistor; a luminescence element connected to a drain of the drive transistor; a first switching transistor inserted between a source of the drive transistor and the other of the terminals of the first capacitor element, that includes a gate connected to the first control line; a second switching transistor that includes a gate connected to the second control line, and switches between ON and OFF states of the drain current of the drive transistor; and a second capacitor element inserted between the other of the terminals of the first capacitor element and the third control line, each of the pixels in an odd drive block further includes a third switching transistor inserted between the first signal line and the gate of the drive transistor, each of the pixels in an even drive block further includes a fourth switching transistor inserted between the second signal line and the gate of the drive transistor, and the first control line and the third control line are connected to the pixels in a same one of the drive blocks. With this, the drive transistor threshold voltage correction periods as well as the luminescence periods can be made uniform within the drive block. Therefore, the load on the drive circuit is decreased. Furthermore, since a long threshold voltage correction period can be taken with respect to one frame period, image display quality is improved.

Hereinafter, an embodiment of the present invention shall be described with reference to the Drawings.

FIG. 1 is a block diagram showing the electrical configuration of a display device according to a first embodiment of the present invention. A display device 1 in the figure includes a display panel 10, a timing control circuit 20, and a voltage control circuit 30. The display panel 10 includes plural pixels 11A and 11B, a signal line group 12, a control line group 13, a scanning/control line drive circuit 14, and a signal line drive circuit 15.

The pixels 11A and 11B are arranged in rows and columns on the display panel 10. Here, the pixels 11A and 11B compose two or more drive blocks each of which is one drive block made up of plural pixel rows. The pixels 11A compose a k-th drive block (k is a positive integer) and the pixels 11B compose a (k+1)-th drive block. However, in the case where the display panel 10 is divided into N drive blocks, (k+1) is a positive integer equal to or less than N. This means that, for example, the pixels 11A compose odd drive blocks and the pixels 11B compose even drive blocks.

The signal line group 12 includes plural signal lines disposed in each of the pixel columns. Here, two signal lines are disposed in each of the pixel columns, the pixels of odd drive blocks are connected to a first signal line, and the pixels of even drive blocks are connected to a second signal line different from the first signal line.

The control line group 13 includes scanning lines and control lines, with each of the scanning lines and each of the control lines disposed on a per pixel basis.

The scanning/control line drive circuit 14 drives the circuit element of each pixel by outputting a scanning signal to the respective scanning lines of the control line group 13 and outputting a control signal to the respective control lines of the control line group 13.

The signal line drive circuit 15 drives the circuit element of each pixel by outputting a luminance signal or a reference signal to the respective signal lines of the signal line group 12.

The timing control circuit 20 controls the output timing of scanning signals and control signals outputted from the scanning/control line drive circuit 14. Furthermore, the timing control circuit 20 controls the timing for the outputting of luminance signals or reference signals outputted to the first signal line and the second signal line from the signal line drive circuit 15. The timing control circuit 20 causes the signal line drive circuit 15 to output the reference voltage to the second signal line while causing the outputting of the luminance signal to the first signal line, and causes the signal line drive circuit 15 to output the reference voltage to the first signal line while causing the outputting of the luminance signal to the second signal line. In other words, timing control circuit 20 causes the luminance signal and the reference signal to be outputted mutually exclusively to the first signal line and the second signal line.

The voltage control circuit 30 controls the voltage level of the scanning signals and the control signals outputted from the scanning/control line drive circuit 14.

Figure 2A:
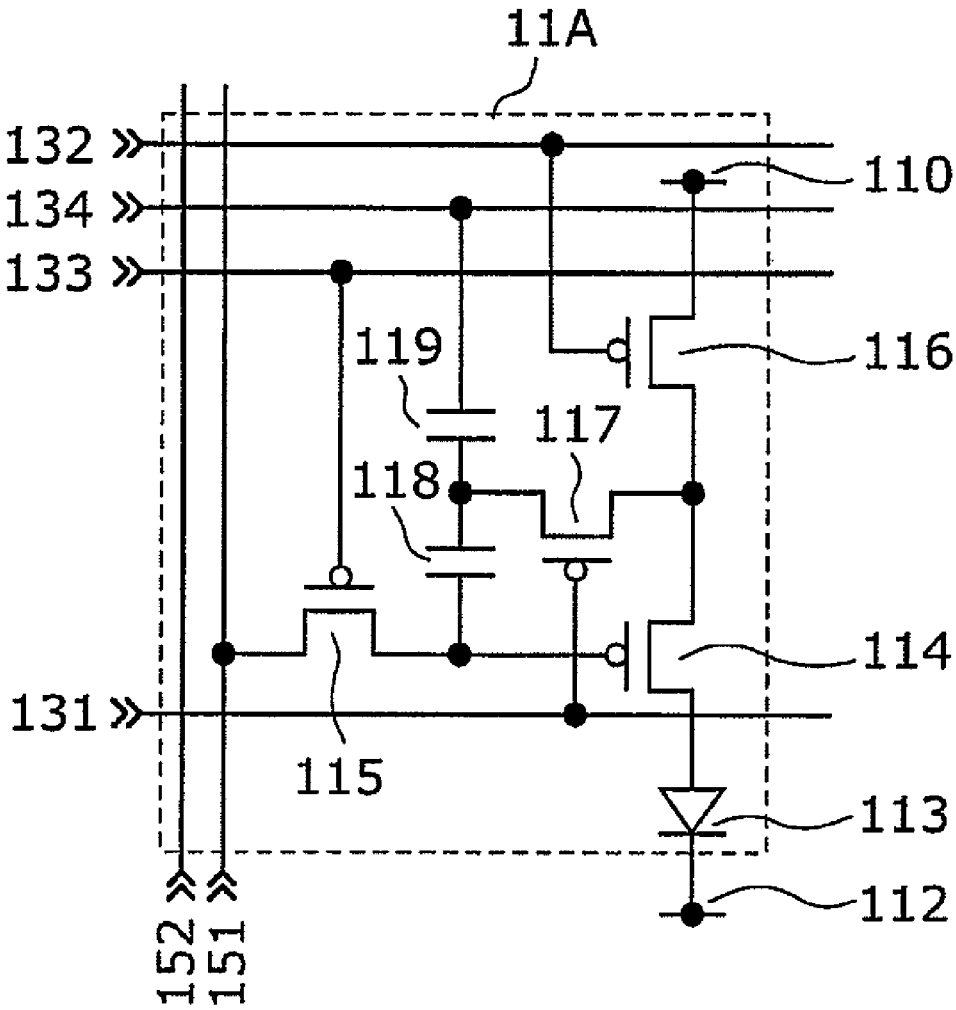
FIG. 2 A is a specific circuit configuration diagram of a pixel of an odd drive block in the display device according to the first embodiment of the present invention.
Figure 2B:
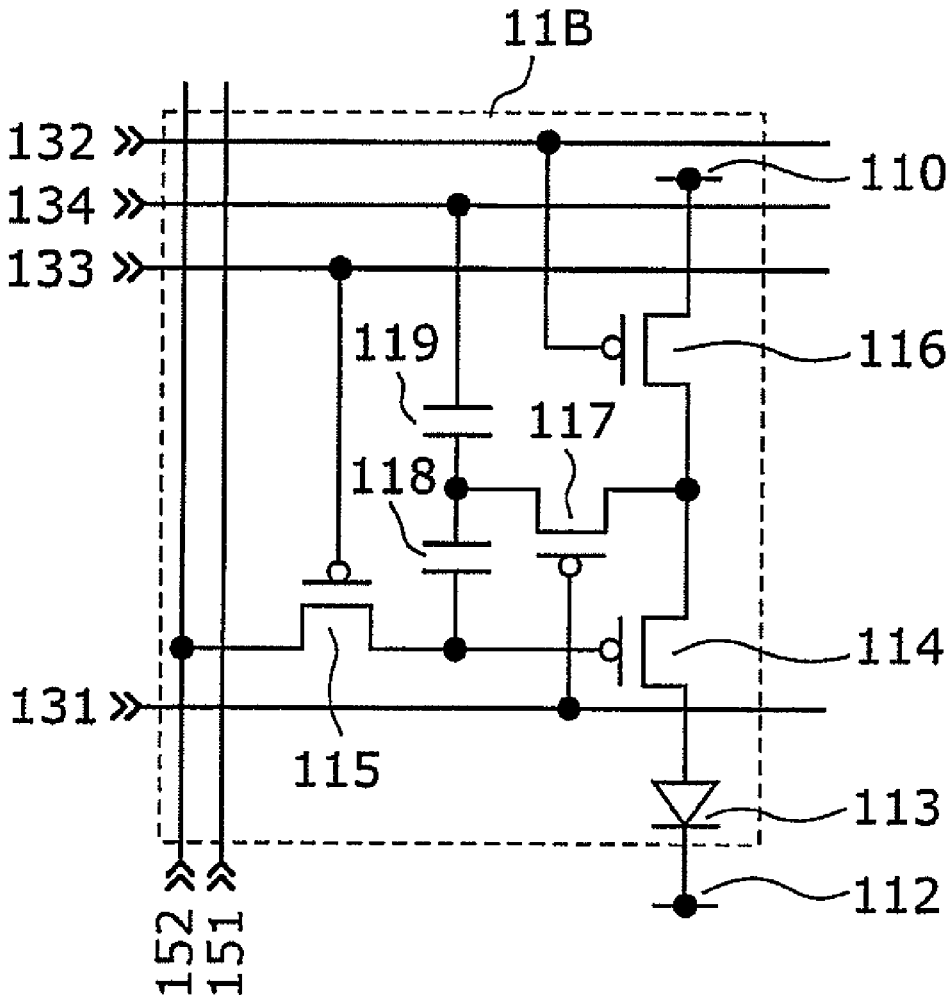

FIG. 2 A is a specific circuit configuration diagram of a pixel of an odd drive block in the display device according to the first embodiment of the present invention, and FIG. 2 B is a specific circuit configuration diagram of a pixel of an even drive block in the display device according to the first embodiment of the present invention. Each of the pixels 11A and 11B shown in FIG. 2A and FIG. 2B, respectively, include: an organic electroluminescence (EL) element 113; a drive transistor 114; switching transistors 115, 116, and 117; electrostatic storing capacitors 118 and 119, a first control line 131; a second control line 132; a scanning line 133; a third control line 134; a first signal line 151; and a second signal line 152.

In FIG. 2A and FIG. 2B, the organic EL element 113 is a luminescence element having a cathode connected to the power source line 112, which is a second power source line, and an anode connected to the drain of the drive transistor 114. The organic EL element 113 generates photons according to the flow of the drive current of the drive transistor 114.

The drive transistor 114 is a drive transistor having a source connected to one of the source and the drain of the switching transistor 116, and a drain connected to the anode of the organic EL element 113. The drive transistor 114 converts a signal voltage applied between the gate and source into a drain current corresponding to such signal voltage. Subsequently, the drive transistor 114 supplies this drain current, as a drive current, to the organic EL element 113. The drive transistor 114 is configured of a P-type thin film transistor (P-type TFT).

The switching transistor 115 has a gate connected to the scanning line 133, and one of a source and a drain connected to the gate of the drive transistor 114. Furthermore, the other of the source and the drain is connected to the first signal line 151 and functions as a third switching transistor in the pixel 11A in the odd drive block, and is connected to the second signal line 152 and functions as a fourth switching transistor in the pixel 11B in the even drive block.

The switching transistor 116 is a second switching transistor having a gate connected to the second control line 132, and the other of a source and a drain connected to the power source line 110 which is a first power source line. The switching transistor 116 has a function of turning ON and OFF the drain current of the drive transistor 114.

It should be noted that the source and the drain of the switching transistor 116 are connected between the power source line 110 and the source of the drive transistor 114. With this arrangement, the drain current of the drive transistor 114 can be turned ON and OFF.

The switching transistor 117 is a first switching transistor having a gate connected to the first control line 131, one of a source and a drain connected to the other of terminals of the electrostatic storing capacitor 118, and the other of the source and the drain connected to the source of the drive transistor 114. The switching transistor 117 turns OFF in the period for storing the luminance voltage from the signal line, and thus leak current from the electrostatic storing capacitors 118 and 119 to the drive transistor 114 is not generated in such period. Therefore, the switching transistor 117 has a function of causing accurate voltages corresponding to the signal voltage and to the threshold voltage of the drive transistor 114 to be stored in the electrostatic storing capacitors 118 and 119. Furthermore, with the switching transistor 117, such period is not restricted to high-speed storing for controlling the leak current, and thus the storing period necessary for storing an accurate luminance signal voltage can be secured. Meanwhile, by turning ON in the threshold voltage detection period and the luminescence production period, the switching transistor 117 has a function of connecting the source of the drive transistor 114 to the electrostatic storing capacitors 118 and 119, causing a voltage corresponding to the threshold voltage and the signal voltage to be stored accurately in the electrostatic storing capacitor 118, and causing the drive transistor 114 to supply the luminescence element with a drive current reflecting the voltage stored in the electrostatic storing capacitor 118. The switching transistors 115, 116, and 117 are each configured of a P-type thin film transistor (P-type TFT).

The electrostatic storing capacitor 118 is a first capacitor element having a first electrode, which is one of its terminals, connected to the gate of the drive transistor 114 and a second electrode, which is the other of the terminals, connected to one of the source and the drain of the switching transistor 117. The electrostatic storing capacitor 118 has a function of storing a voltage corresponding to the signal voltage supplied from the first signal line 151 or the second signal line 152 and to the threshold voltage of the drive transistor 114, and controlling a signal current supplied from the drive transistor 114 to the organic EL element 113 after the switching transistor 115 is turned OFF for example.

The electrostatic storing capacitor 119 is a second capacitor element connected between the second electrode of the electrostatic storing capacitor 118 and the third control line 134. First, after the voltage control circuit 30 causes the potential of the third control line 134 to change to the high potential-side so as to cause the generation a voltage larger than the threshold value of the drive transistor 114 between the terminals of the electrostatic storing capacitor 118, the source potential of the drive transistor 114 is stored in the electrostatic storing capacitors 118 and 119 in a steady state through the conduction of the switching transistor 117. It should be noted that the potential of a node between the electrostatic storing capacitors 118 and 119 in the steady state is a voltage obtained by adding the threshold voltage to the gate voltage of the drive transistor 114. Even when the luminance signal voltage is applied to the first electrode of the electrostatic storing capacitor 118 via the switching transistor 115, the information of the source potential of the drive transistor 114 remains in the node between the electrostatic storing capacitor 118 and the electrostatic storing capacitor 119. Therefore, with the application of the aforementioned luminance signal voltage, a voltage corresponding to the voltage difference between the luminance signal voltage of the first signal line 151 or the second signal line 152 and the reference voltage is applied to the electrostatic storing capacitor 118. Subsequently, even when the timing from the storing of the aforementioned signal voltage to the production of luminescence is different for each of the pixel rows, the potential of the second electrode of the electrostatic storing capacitor 118 is fixed and thus the potential of the first electrode of the electrostatic storing capacitor 118 is also fixed, and thus the gate voltage of the drive transistor 114 is fixed.

The first control line 131 is connected to the scanning/control line drive circuit 14, and is connected to the respective pixels belonging to the pixel row including the pixels 11A or 11B. With this, the first control line 131 has a function of selecting a conductive or non-conductive state between the source of the drive transistor 114 and the node between the electrostatic storing capacitor 118 and the electrostatic storing capacitor 119.

The second control line 132 is connected to the scanning/control line drive circuit 14, and is connected to the respective pixels belonging to the pixel row including the pixels 11A or 11B. With this, the second control line 132 has a function of supplying the timing for turning the drain current of the drive transistor 1140N and OFF.

The third control line 134 is connected to the scanning/control line drive circuit 14, and is connected to the respective pixels belonging to the pixel row including the pixels 11A or 11B. With this, the third control line 134 has a function of adjusting the environment for detecting the threshold voltage of the drive transistor 114, by switching voltage levels.

The scanning line 133 has a function of supplying the respective pixels belonging to the pixel row including the pixels 11A or 11B with the timing for storing a signal voltage which is the luminance signal voltage or the reference voltage.

Each of the first signal line 151 and the second signal line 152 is connected to the signal line drive circuit 15 and the respective pixels belonging to the pixel column including the pixels 11A or 11B, and has a function of supplying: the reference voltage for detecting the threshold voltage of the drive TFT; and the signal voltage which determines luminance intensity.

It should be noted that, although not shown in FIG. 2A and FIG. 2B, the power source line 110 and the power source line 112 are a positive power source line and a negative power source line, respectively, and each is also connected to other pixels and to a voltage source.

Next, the inter-pixel connection relationship of the first control line 131, the second control line 132, the third control line 134, the scanning line 133, the first signal line 151, and the second signal line 152 shall be described.

Figure 3:
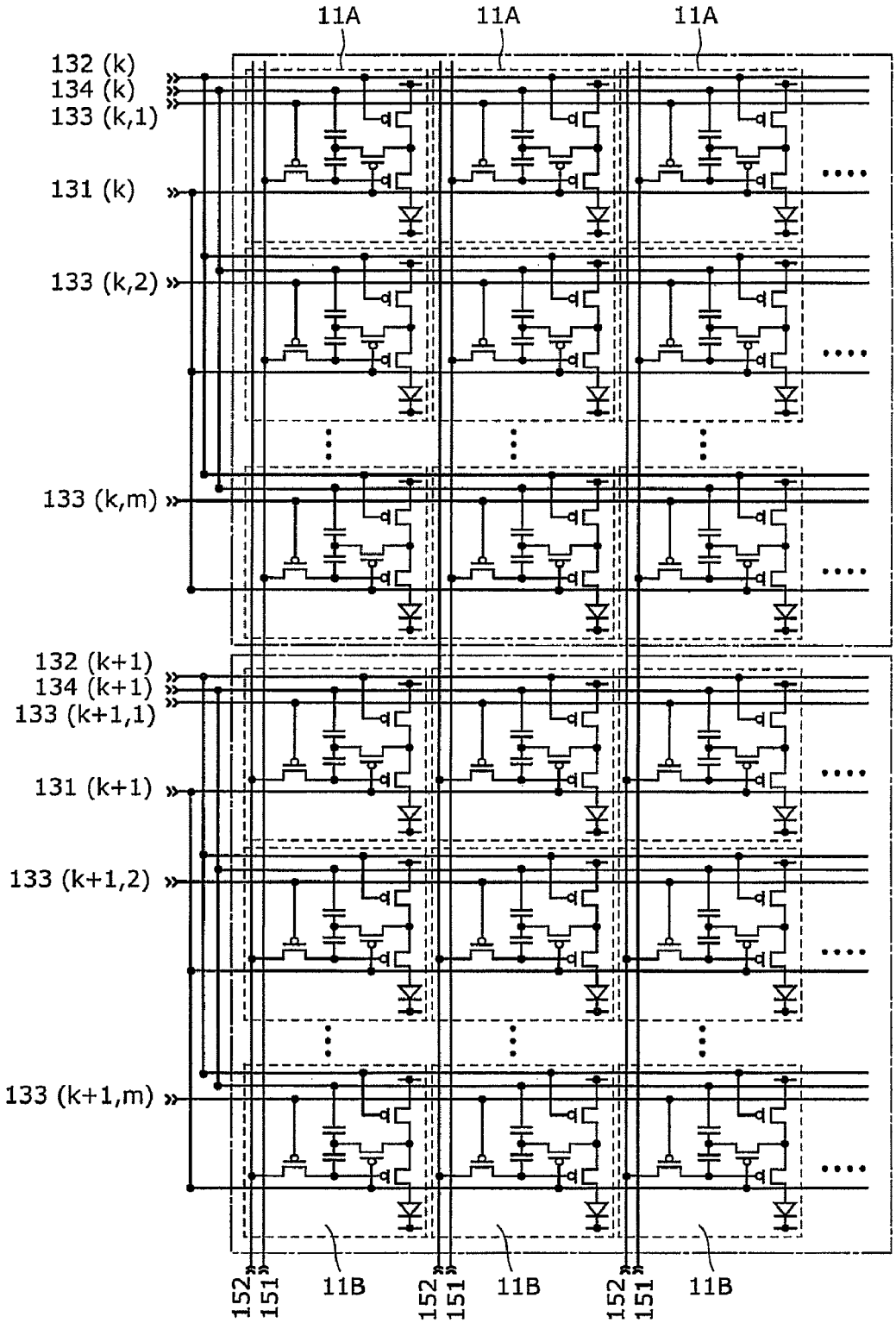
FIG. 3 is a circuit configuration diagram showing part of a display panel included in the display device according to a first embodiment of the present invention.

FIG. 3 is a circuit configuration diagram showing part of the display panel included in the display device according to the first embodiment of the present invention. The figure shows two adjacent drive blocks and respective control lines, respective scanning lines, and respective signal lines. In the figure and the subsequent description, the respective control lines, respective scanning lines, and respective signal lines shall be represented by "reference number (block number; row number of the block)" or "reference number (block number)".

As previously described, a drive block includes plural pixel rows, and there are two or more drive blocks within the display panel 10. For example, each of the drive blocks shown in FIG. 3 includes m rows of pixel rows.

In the k-th drive block shown at the top stage of FIG. 3, the first control line 131 (*k*) is connected in common to the gates of the respective switching transistors 117 included in all the pixels 11A in the drive block. Furthermore, the second control line 132 (*k*) is connected in common to the gates of the respective switching transistors 116 included in all the pixels 11A in the drive block. Furthermore, the third control line 134 (*k*) is connected in common to the respective electrostatic storing capacitors 119 included in all the pixels 11A in the drive block. Meanwhile, each of the scanning lines 133 (*k*, 1) to 133 (*k, m*) are separately connected on a per pixel row basis. Specifically, the first control line 131 is connected to the scanning/control line drive circuit 14, and is connected to the respective pixels belonging to the pixel row including the pixels 11A or 11B.

Furthermore, the same connections as those in the k-th drive block are also carried out on the (k+1)-th drive block shown in the bottom stage of FIG. 3. However, the first control line 131 (*k*) connected to the k-th drive block and the first control line 131 (*k*+1) connected to the (k+1)-th drive block are different control lines, and separate control signals are outputted from the scanning/control line drive circuit 14. Furthermore, the second control line 132 (*k*) connected to the k-th drive block and the second control line 132 (*k*+1) connected to the (k+1)-th drive block are different lines, and separate control signals are outputted from the scanning/control line drive circuit 14. Furthermore, the third control line 134 (*k*) connected to the k-th drive block and the third control line 134 (*k*+1) connected to the (k+1)-th drive block are different control lines, and separate control signals are outputted from the scanning/control line drive circuit 14. Specifically, the first control lines 131, the second control lines 132, and the third control lines 134 are shared by all of the pixels in a same one of the drive blocks, and are independent of another between different ones of the drive blocks. Here, control lines are shared in the same one of the drive blocks means that a single control signal outputted from the scanning/control line drive circuit 14 is simultaneously supplied to the control lines in the same one of the drive blocks. For example, in the same one of the drive blocks, a single control line connected to the scanning/control line drive circuit 14 branches out to the first control lines 131 which are disposed on a per pixel row basis. Furthermore, the control lines are independent between different drive blocks means that separate control signals outputted from the scanning/control line drive circuit 14 are supplied to the plural drive blocks. For example, the first control lines 131 are individually connected to the scanning/control line drive circuit 14 on a per drive block basis.

Furthermore, in the k-th drive block, the first signal line 151 is connected to the other of the source and drain of the respective switching transistors 115 included in all of the pixels 11A in the drive block. Meanwhile, in the (k+1)-th drive block, the second signal line 152 is connected to the other of the source and drain of the respective switching transistors 115 included in all of the pixels 11B in the drive block.

With the above-described formation of drive blocks, the number of first control lines 131 for controlling the connection between the source of the respective drive transistors 114 and the node between the respective electrostatic storing capacitors 118 and electrostatic storing capacitors 119 is reduced. Furthermore, the number of second control lines 132 for controlling the turning ON and OFF of the voltage application to the source of the respective drive transistors 114 is reduced. Furthermore, the number of third control lines 134 for controlling respective Vth detection circuits which detect the threshold voltage Vth of the corresponding drive transistors 114 is reduced. Therefore, the number of outputs of the scanning/control line drive circuit 14 which outputs drive signals to these control lines is reduced, thus allowing a reduction in circuit size.

Figure 4A:
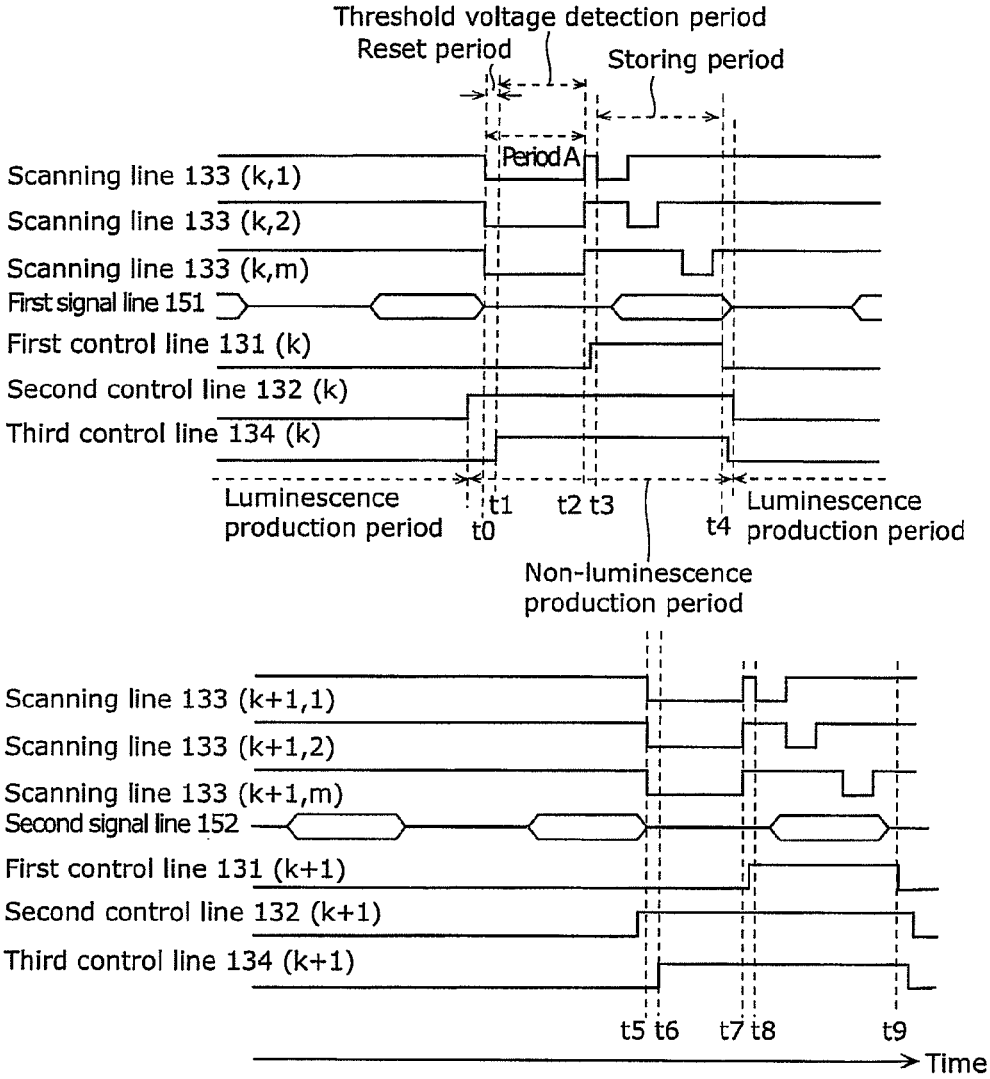
FIG. 4A is an operation timing chart for a driving method of the display device according to the first embodiment of the present invention.

Next, the driving method of the display device 1 according to the present embodiment shall be described using FIG. 4A. It should be noted that, here, the driving method of the display device including the specific circuit configuration shown in FIG. 2A and FIG. 2B shall be described in detail.

Figure 5:
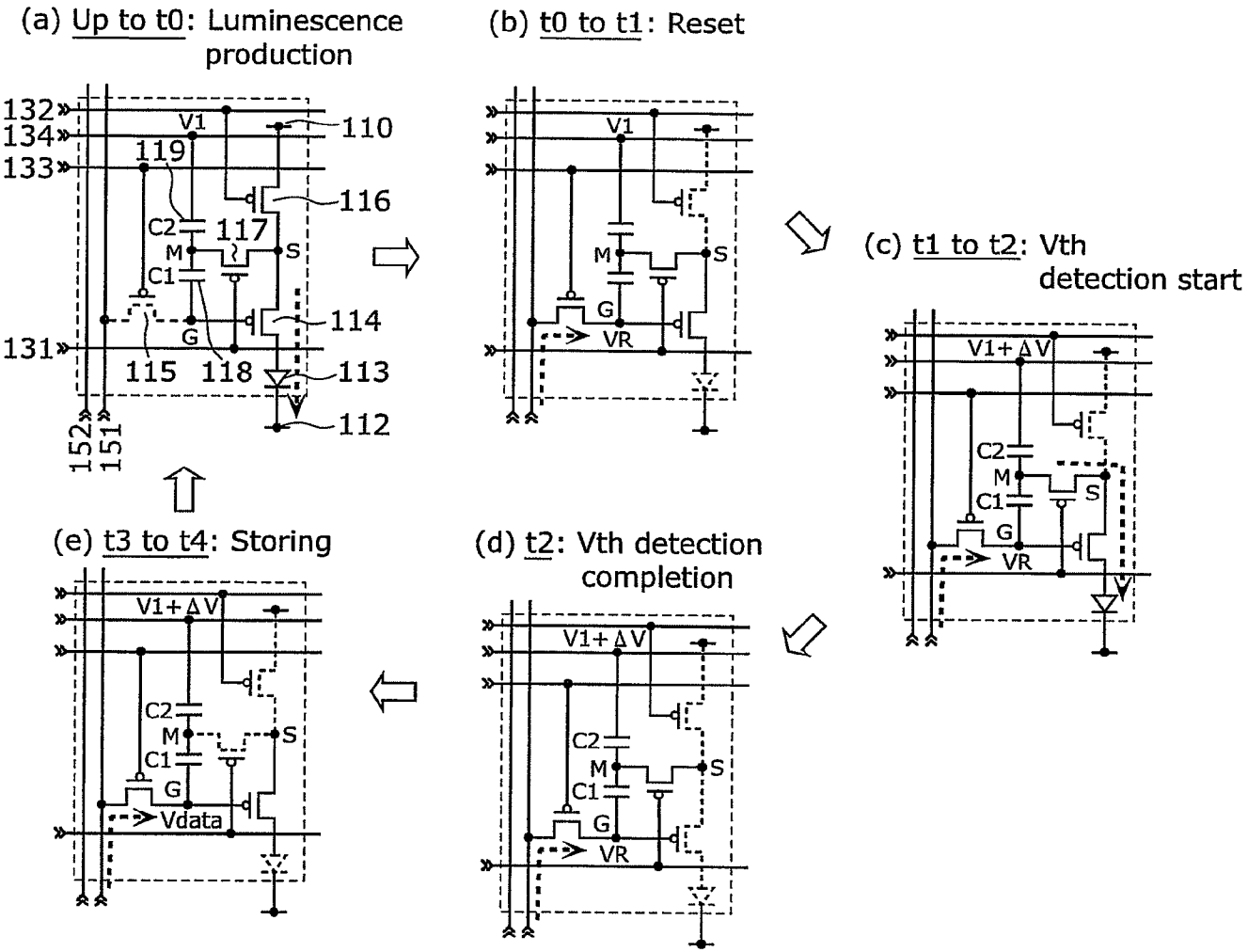
FIG. 5 is a state transition diagram for a pixel included in the display device according to the first embodiment of the present invention.
Figure 6:
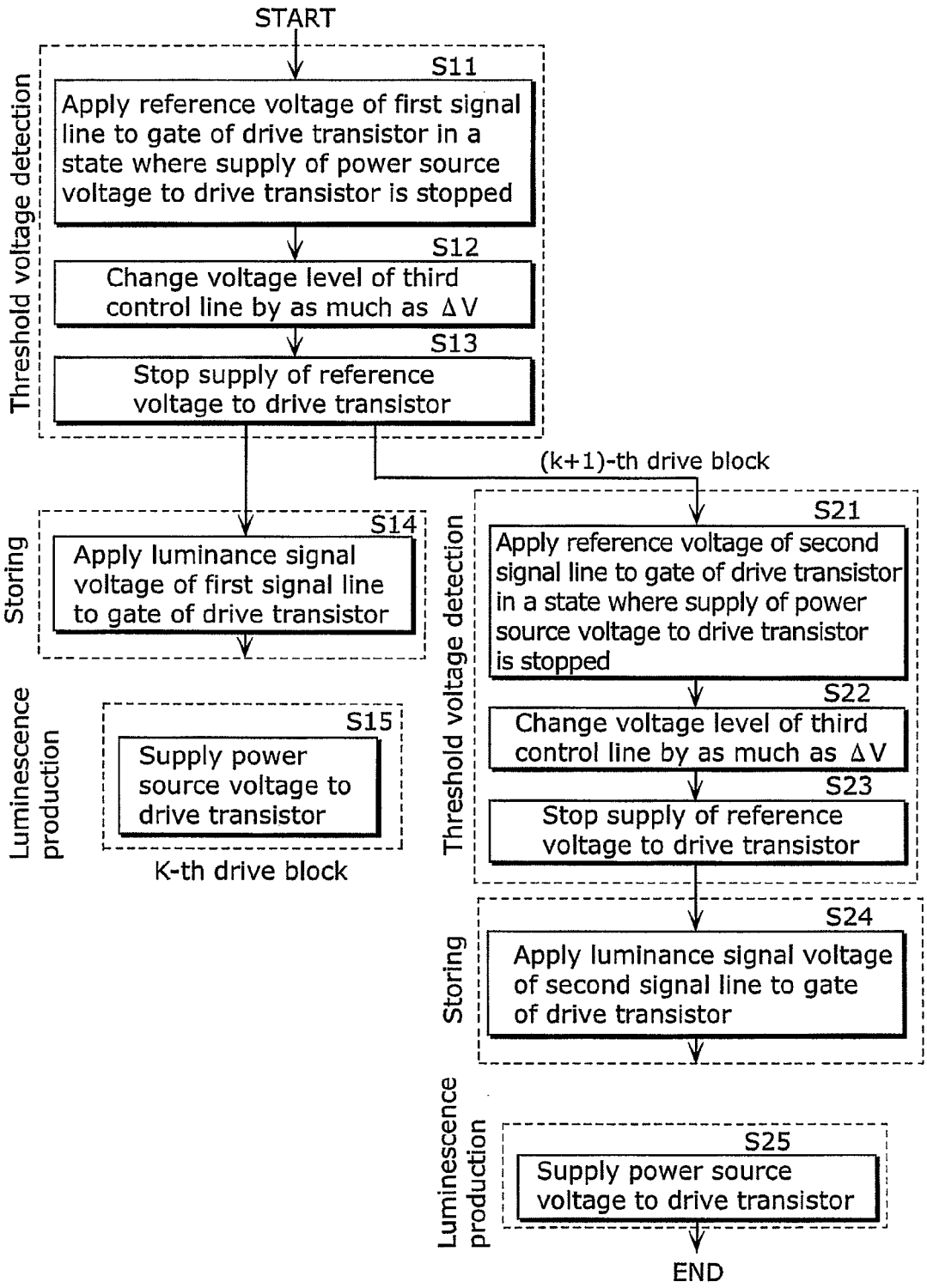
FIG. 6 is an operation flowchart for the display device according to the first embodiment of the present invention.

FIG. 4A is an operation timing chart for the driving method of the display device according to the first embodiment of the present invention. In the figure, the horizontal axis denotes time. Furthermore, in the vertical direction, the waveform diagrams of the voltage generated in the scanning lines 133 (*k*, 1), 133 (*k*, 2), and 133 (*k, m*), the first signal line 151, the first control line 131 (*k*), the second control line 132 (*k*), and the third control line 134 (*k*) of the k-th drive block are shown in sequence from the top. Furthermore, continuing therefrom, the waveform diagrams of the voltage generated in the scanning lines 133 (*k*+1, 1), 133 (*k*+1, 2), and 133 (*k*+1, *m*), the second signal line 152, the first control line 131 (*k*+1), the second control line 132 (*k*+1), and the third control line 134 (*k*+1) of the (k+1)-th drive block are shown. Furthermore, FIG. 5 is a state transition diagram for a pixel included in the display device according to the first embodiment of the present invention. Furthermore, FIG. 6 is an operation flowchart for the display device according to the first embodiment of the present invention.

First, immediately before a time t0, the voltage levels of the scanning lines 133 (*k*, 1) to 133 (*k, m*) are all HIGH, and the voltage level of the second control line 132 (*k*) is also HIGH. From the moment that the voltage level of the second control line 132 (*k*) is HIGH, the switching transistor 116 turns OFF. With this, the organic EL element 113 stops generating photons, and the concurrent generation of photons of the pixels in the k-th drive block ends. At the same time, the non-luminescence production period of the k-th drive block begins.

Next, at a time t0, the scanning/control line drive circuit 14 causes the voltage levels of the scanning lines 133 (*k*, 1) to 133 (*k, m*) to simultaneously change from HIGH to LOW so as to turn ON the switching transistor 115. Furthermore, at this time, the voltage level of the second control line 132 (*k*) is already at LOW and the switching transistor 116 is already OFF, and the signal line drive circuit 15 causes the signal voltage of the first signal line 151 to change from the luminance signal voltage to the reference voltage with which the drive transistor 114 turns OFF (S11 in FIG. 6). With this, as shown in (b) in FIG. 5, all of the pixels belonging to the k-th drive block are reset through the application of the reference voltage VR to the gate of the drive transistor 114. The operation of applying the aforementioned reference voltage to the gate of the drive transistor 114 corresponds to the simultaneous applying of the reference voltage in the k-th drive block. It should be noted that the timing for changing the voltage level of the second control line 132 (*k*) from LOW to HIGH to turn OFF the switching transistor 116 need not necessarily be prior to the time t0, and may be between the times t0 and t1.

Here, in a luminescence production period prior to the time t0, a voltage (−V'+Vth) obtained by correcting a voltage V' corresponding to the signal voltage Vdata (a negative voltage value) using the threshold voltage Vth of the drive transistor 114 is stored in the electrostatic storing capacitor 118.

In this state, at the time t0, when the switching transistor 115 is turned ON and the reference voltage VR is applied to the first electrode of the electrostatic storing capacitor 118 from the first signal line 151 instead of the Vdata, the potential $V_M$ of the second electrode of the electrostatic storing capacitor 118 is expressed using Expression 1 below.

[Math. 1]

$$V_M = V_M(0) \quad \text{(Expression 1)}$$

Next, at the time t1, the scanning/control line drive circuit 14 causes the voltage level of the third control line 134 (*k*) to change from LOW to HIGH (S12 in FIG. 6). At this time, when the voltage level of the third control line 134 (*k*) is caused to change by as much as ΔV, the potential of the second electrode of electrostatic storing capacitor 118 rises by as much as a voltage distributed according to the capacitance ratio between the electrostatic storing capacitor 118 and the electrostatic storing capacitor 119. Here, when the respective capacitances of the electrostatic storing capacitor 118 and the electrostatic storing capacitor 119 are denoted as C1 and C2, the potential $V_M$ of the electrostatic storing capacitor 118 is expressed using Expression 2.

[Math. 2]

$$V_M = \frac{C_2}{C_1 + C_2}\Delta V + V_M(0) \quad \text{(Expression 2)}$$

Through the changing of the voltage level of the third control line 134 (*k*) from LOW to HIGH, ΔV is set in advance to Vgs which is the gate-source voltage of the drive transistor 114 so that a voltage higher than the threshold voltage Vth of the drive transistor 114 is generated therein. Specifically, the potential difference generated in the electrostatic storing capacitor 118 is set to be a potential difference which allows for the detection of threshold voltage, thereby completing the preparation for the threshold voltage detection process. The above-described operation of causing the voltage level of the third control line 134 (*k*) by as much as ΔV corresponds to the simultaneous applying of the initializing voltage in the k-th drive block.

Here, when the potential of the first electrode of the electrostatic storing capacitor 118 is set to $V_G$, the voltage ($V_M$−$V_G$) stored in the electrostatic storing capacitor 118 is expressed using Expression 3.

[Math. 3]

$$V_M - V_G = \frac{C_2}{C_2 + C_2}\Delta V + V_M(0) - VR \quad \text{(Expression 3)}$$

At this time, since the voltage level of the second control line 132 (*k*) is maintained at HIGH, there is no supply of current from the positive power source line 110 to the drive transistor 114, and, as shown in (c) in FIG. 5, the discharge current corresponding to the voltage stored in the electrostatic storing capacitor 118 begins to flow to the drive transistor 114 and the organic EL element 113.

Between the time t1 and a time t2, the voltage stored in the electrostatic storing capacitor 118 which is expressed using Expression 3 becomes asymptotic to the threshold voltage Vth of the drive transistor 114, due to such discharge current.

[Math. 4]

$$V_M - V_G \rightarrow Vth \quad \text{(Expression 4)}$$

Then, as shown in (d) in FIG. 5, when the voltage stored in the electrostatic storing capacitor 118 becomes the threshold voltage Vth of the drive transistor 114, the discharge current stops. The $V_G$ and $V_M$ at this time is expressed using Expression 5.

[Math. 5]

$$V_G = VR,\ V_M = VR + Vth \quad \text{(Expression 5)}$$

It should be noted that, since the flowing discharge current for causing the voltage equivalent to the threshold voltage Vth to be stored in the electrostatic storing capacitor 118 is minute, it takes time for the voltage stored in the electrostatic storing capacitor 118 to become asymptotic to the threshold voltage Vth of the drive transistor 114 and reach the steady state. Therefore, the longer this period is, the more stable the voltage stored in the electrostatic storing capacitor 118 becomes, and by ensuring that this period is sufficiently long, voltage compensation having high-precision is realized.

As described thus far, in the period from the time t1 to the time t2, the correction of the threshold voltage Vth of the drive transistor 114 is executed simultaneously in the k-th drive block, and a voltage corresponding to the threshold voltage Vth of the drive transistor 114 is stored simultaneously in the respective electrostatic storing capacitors 118 of all the pixels 11A in the k-th drive block.

Next, at the time t2, the scanning/control line drive circuit 14 causes the voltage levels of the scanning lines 133 (*k*, 1) to 133 (*k, m*) to simultaneously change from LOW to HIGH so as to turn OFF the switching transistor 115 (S13 in FIG. 6). This completes the threshold voltage detection operation of the pixels belonging to the k-th drive block. The above-described operation of turning OFF the switching transistor 115 to stop the supply of the reference voltage to the gate of the drive transistor 114 corresponds to the simultaneous causing of the non-conduction in the (k+1)-th drive block.

The above-described simultaneous applying of the reference voltage in the k-th drive block, the simultaneous applying of the initializing voltage in the k-th drive block, and the simultaneous causing of the non-conduction in the k-th drive block correspond to the storing of the voltage (corresponding to the threshold voltage of a corresponding drive transistor) in the k-th drive block.

Next, in a period from the time t2 to the time t3, the scanning/control line drive circuit 14 causes the voltage level of the first control line 131 (*k*) to change from LOW to HIGH so as to turn OFF the switching transistor 117. This completes the preparation for storing the luminance signal voltage to the pixels belonging to the k-th drive block. Because the switching transistor 117 is OFF during the luminance signal voltage storing period, the current path between the second electrode of the electrostatic storing capacitor 118 and the source of the drive transistor 114 is blocked. Therefore, during the storing period, the discharge current from the electrostatic storing capacitor 118 to the drive transistor 114 does not flow, and an accurate voltage corresponding to the luminance signal voltage is stored in the electrostatic storing capacitor 118. Furthermore, due to the blocking of the current path, the aforementioned period does not require a high-speed storing operation of turning the switching transistor 115 for controlling the discharge current, from OFF to ON and then from ON to OFF again at high speed.

Next, between the time t3 to a time t4, the scanning/control line drive circuit 14 causes the voltage levels of the scanning lines 133 (k, 1) to 133 (*k, m*) to sequentially change from HIGH to LOW to HIGH so as to sequentially turn ON the switching transistors 115 on a per pixel row basis. Furthermore, at this time, the signal line drive circuit 15 causes the signal voltage of the first signal line 151 to change from the reference voltage VR to the luminance signal voltage Vdata (S14 in FIG. 6). With this, as shown in (e) in FIG. 5, the luminance signal voltage Vdata is applied to the gate of the drive transistor 114. At this time, the potential $V_M$ of the second electrode of the electrostatic storing capacitor 118 becomes the sum of the voltage resulting from the distribution of the signal voltage change amount (Vdata−VR) between C1 and C2, and (VR+Vth) which is the $V_M$ potential at the time t2, and is expressed using Expression 6.

[Math. 6]

$$V_M = \frac{C_1}{C_1 + C_2}(V_{data} - VR) + VR + Vth \quad \text{(Expression 6)}$$

The potential difference Vsg stored in the electrostatic storing capacitor 118 is the difference between $V_M$ defined in Expression 6 and Vdata which is the potential of $V_G$, and is expressed using Expression 7.

[Math. 7]

$$V_{gs} = \frac{C_2}{C_1 + C_2}(VR - V_{data}) + Vth \quad \text{(Expression 7)}$$

In other words, a summed voltage obtained by adding a voltage corresponding to this luminance signal voltage Vdata and the voltage equivalent to the previously stored threshold voltage Vth of the drive transistor 114 is stored into the electrostatic storing capacitor 118. The above-described operation of storing the summed voltage corresponds to the storing of a summed voltage in the k-th drive block.

As described thus far, in a period from the time t3 to the time t4, the storing of the corrected luminance signal voltage is sequentially executed in the k-th drive block on a per pixel row basis.

Next, at a time t4, the scanning/control line drive circuit 14 causes the voltage level of the first control line 131 (*k*) to change from HIGH to LOW. Furthermore, almost simultaneously, the scanning/control line drive circuit 14 causes the voltage levels of the second control line 132 (*k*) and the third control line 134 (*k*) to change from HIGH to LOW (S15 in FIG. 6). With this, a drive current corresponding to the summed voltage flows to the organic EL element 113 as shown in (a) in FIG. 5. In other words, generation of photons begins simultaneously in all the pixels 11A in the k-th drive block. The above-described photon generation operation corresponds to the generating of the photons in the k-th drive block.

As described above, in the period from the time when the voltage level of the second control line 132 (*k*) is caused to change from HIGH to LOW, the photon generation of the organic EL elements 113 is executed simultaneously in the k-th drive block. Here, a drain current $i_d$ flowing in the drive transistor 114 is expressed in Expression 8, by using a voltage value obtained by deducting the threshold voltage Vth of the drive transistor 114 from the Vgs defined in Expression 7.

[Math. 8]

$$i_d = \frac{\beta}{2} \cdot \frac{C_2}{C_1 + C_2} \cdot (VR - V_{data}) \quad \text{(Expression 8)}$$

Here, β is a characteristic parameter regarding mobility, gate insulating film capacitance, and the size of the channel region of the transistor. It can be seen from Expression 8 that the drain current $i_d$ for causing the organic EL element 113 to generate photons is a current that is not dependent on the threshold voltage Vth of the drive transistor 114.

As described thus far, by forming the pixel rows into drive blocks, the correction of the threshold voltage Vth of the drive transistors 114 is executed simultaneously in the respective drive blocks. Furthermore, the generation of photons by the organic EL elements 113 is executed simultaneously in the respective drive blocks. With this, the control for turning the drive current of the drive transistors 1140N and OFF can be synchronized in the respective drive blocks. Therefore, the first control line 131, the second control line 132, and the third control line 134 can be shared in each of the drive blocks.

Furthermore, although the scanning lines 133 (*k*, 1) to 133 (*k, m*) are separately connected to the scanning/control line drive circuit 14, the timing of the drive pulse in the threshold voltage compensation period is the same. Therefore, the scanning/control line drive circuit 14 can suppress the rising of the frequency of the pulse signals to be outputted, and thus the output load on the drive circuit is decreased.

Figure 14:
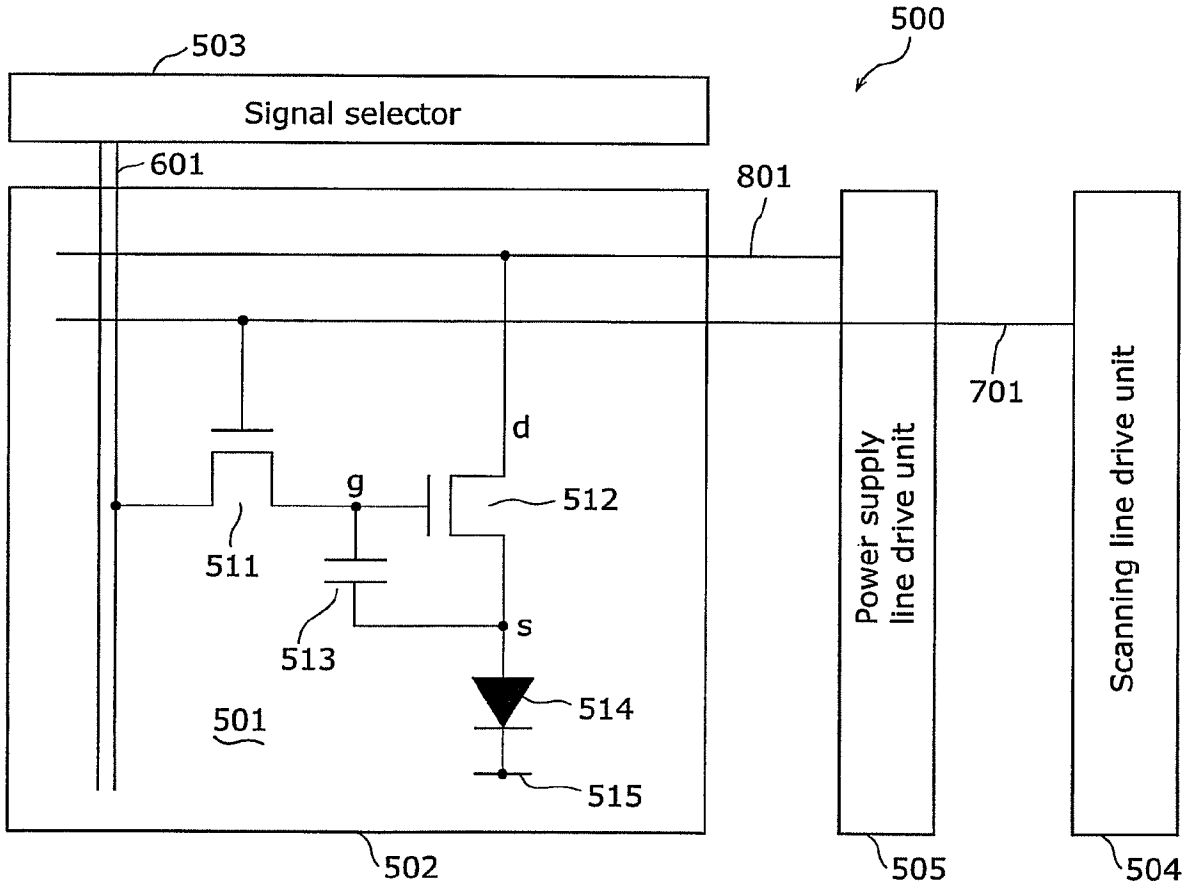
FIG. 14 is a circuit configuration diagram for a pixel included in the conventional image display device disclosed in Patent Reference 1.
Figure 15:
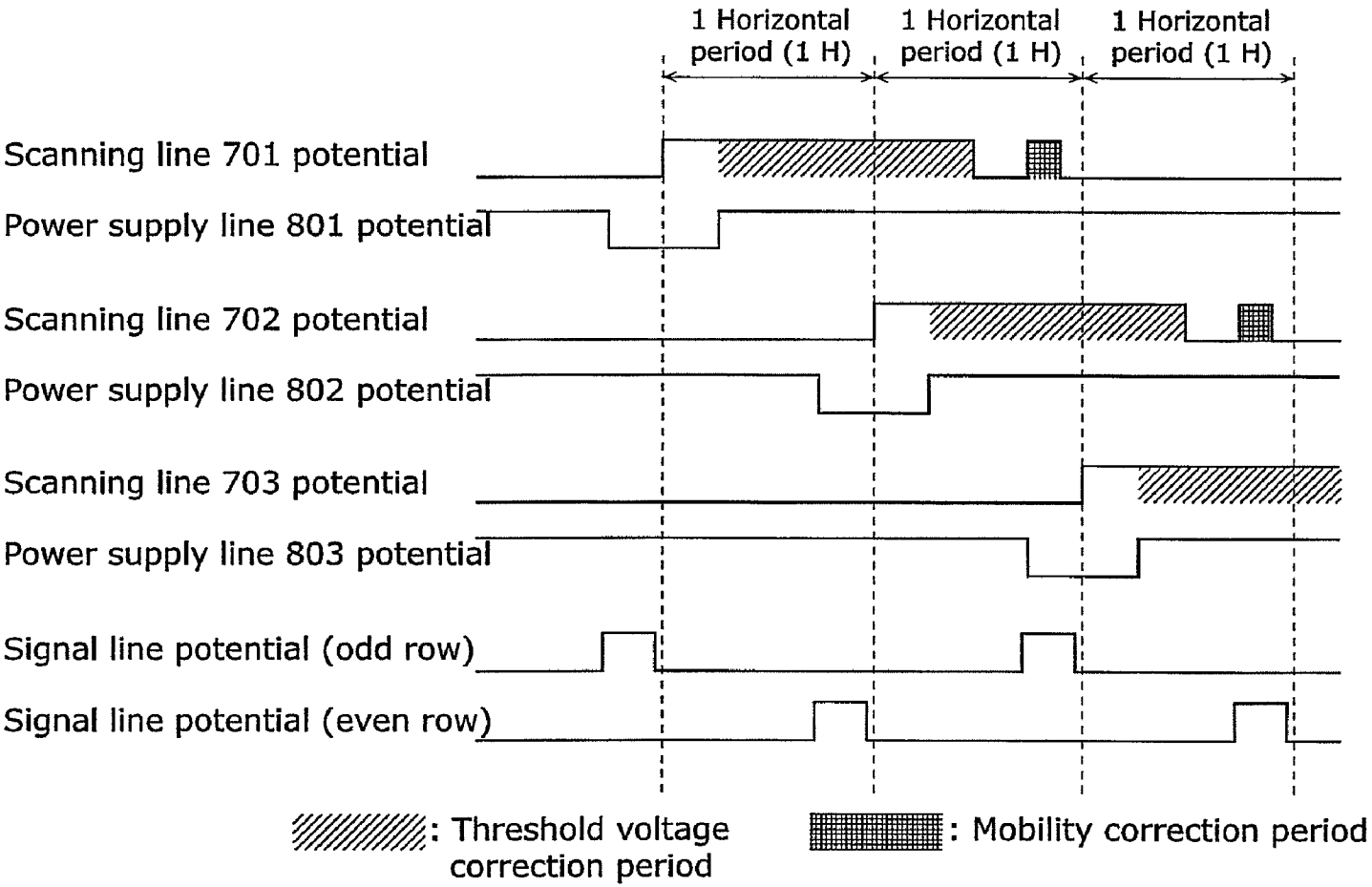
FIG. 15 is an operation timing chart for the image display device disclosed in Patent Reference 1.

The above-described driving method having little output load on the drive circuit is difficult to realize with the conventional image display device 500 disclosed in Patent Reference 1. Even in the pixel circuit diagram shown in FIG. 14, although the threshold voltage Vth the drive transistor 512 is compensated, the source potential of the drive transistor 512 fluctuates and is not fixed after a voltage equivalent to such threshold voltage is stored in the storing capacitor 513. As such, in the image display device 500, after the threshold voltage Vth is stored, the storing of a summed voltage obtained by adding the luminance signal voltage to the threshold voltage Vth must subsequently be executed immediately. Furthermore, since the aforementioned summed voltage is influenced by the fluctuation of the source potential, the photon generation operation must subsequently be executed immediately. Specifically, in the conventional image display device 500, the above-described threshold voltage compensation, luminance signal voltage storing, and photon generation must be executed on a per pixel row basis, and the forming of drive blocks is not possible with the pixels 501 shown in FIG. 14

In contrast, in each of the pixels 11A and 11B included in the display device 1 according to the present invention, the switching transistor 116 is added between the source of the drive transistor 114 and the power source line 110, and the switching transistor 117 is added between the source of the drive transistor 114 and the second electrode of the electrostatic storing capacitor 118 as previously described. With this, the potential in the gate and source of the drive transistor 114 is stabilized, and thus the time from the storing of voltage due to threshold voltage correction up to the additional storing of the luminance signal voltage, or the time from the additional storing up to the luminescence production can be arbitrarily set on a per pixel row basis. According to this circuit configuration, it is possible to form drive blocks, and the threshold voltage correction periods as well as the luminescence production periods can be made uniform within the same drive block.

Here, the comparison of luminescence duty defined according to the threshold voltage detection period is performed in the conventional image display device using the two signal lines described in Patent Reference 1, and the display device having the drive blocks according to the present invention.

Figure 7:
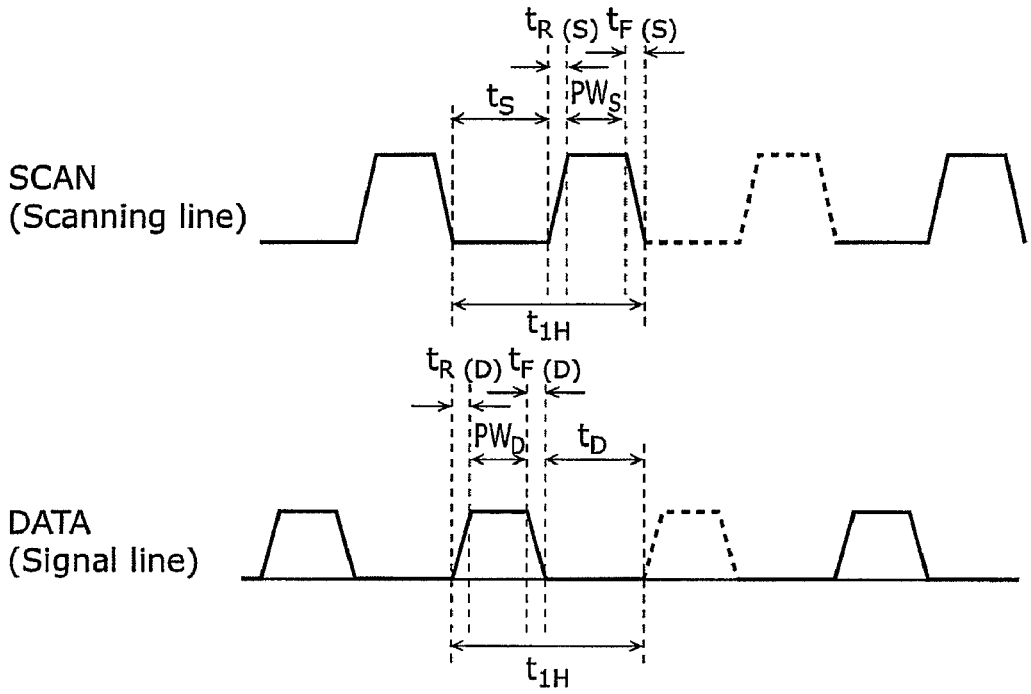
FIG. 7 is a diagram for describing the waveform characteristics of a scanning line and a signal line.

FIG. 7 is a diagram for describing the waveform characteristics of a scanning line and a signal line. In the figure, the period for detecting the threshold voltage Vth in one horizontal period $t_{1H}$ for each pixel row is a period in which the reference voltage is applied to the electrostatic storing capacitor of the respective pixels and is equivalent to $PW_S$ which is the period in which the scanning line is at the HIGH level. It should be noted that, in the waveform characteristics of the scanning line shown in FIG. 7, when the switching transistor for connecting the signal line and the electrostatic storing capacitor is of the P-type, the waveform of the scanning line is a waveform in which the HIGH level and the LOW level are inverted. At this time, $PW_S$ which is the period for detecting the threshold voltage Vth in one horizontal period $t_{1H}$ for each pixel row is in the LOW level.

Furthermore, for a signal line, one horizontal period $t_{1H}$ includes $PW_D$, which is a period in which signal voltage is supplied, and $t_D$ which is a period in which the reference voltage is supplied. Furthermore, assuming the rise time and fall time of $PW_S$ to be $t_{R(S)}$ and $t_{F(S)}$, respectively, and the rise time and fall time of $PW_D$ to be $t_{R(D)}$ and $t_{F(D)}$, respectively, one horizontal period $t_{1H}$ is expressed as in Expression 9.

[Math. 9]

$$t_{1H}=t_D PW_D+t_{R(D)}+t_{F(D)} \quad \text{(Expression 9)}$$

In addition, assuming $PW_D=t_D$, one horizontal period $t_{1H}$ is expressed as in Expression 10.

[Math. 10]

$$t_D+PW_D+t_{R(D)}+t_{F(D)}=2t_D+t_{R(D)}+t_{F(D)} \quad \text{(Expression 10)}$$

From Expression 9 and Expression 10, $t_D$ is expressed using Expression 11.

[Math. 11]

$$t_D=(t_{(1H)}-t_{R(D)}-t_{F(D)})/2 \quad \text{(Expression 11)}$$

Furthermore, since the Vth detection period must begin and end within the reference voltage generation period, $t_D$ is expressed using Expression 12 when a maximum Vth detection period is secured.

[Math. 12]

$$t_D=PW_S+t_{R(S)}+t_{F(S)} \quad \text{(Expression 12)}$$

From Expression 11 and Expression 12, $PW_S$ is expressed as in Expression 13.

[Math. 13]

$$PW_S=(t_{1H}-t_{R(D)}-t_{F(D)}-2t_{R(S)}-2t_{F(S)})/2 \quad \text{(Expression 13)}$$

With respect to Expression 13, a comparison shall be made for the luminescence duty of a panel having a vertical resolution of 1,080 scanning lines (+30 lines for blanking) and which is driven at 120 Hz for example.

In the conventional image display device, one horizontal period $t_{1H}$ in the case of having two signal lines is twice that of the case of having one signal line, and is thus expressed through the subsequent expression.

$$t_{1H}=\{1 \text{ sec.}/(120 \text{ Hz}\times 1110 \text{ lines})\}\times 2=7.5\ \mu\text{S}\times 2=15\ \mu\text{S}$$

Here, $t_{R(D)}=t_{F(D)}=2\ \mu$S and $t_{R(S)}=t_{F(S)}=1.5\ \mu$S are assumed, and when these are substituted into Expression 13, the Vth detection period $PW_S$ becomes 2.5 μS.

Here, assuming that 1000 μS is required for a Vth detection period to have sufficient precision, at least 1000 μS/2.5 μS=400 of horizontal period is needed as a non-luminescence production period in the horizontal period required for such Vth detection. Therefore, the luminescence duty of the conventional image display device using two signal lines becomes (1110 horizontal period−400 horizontal period)/1110 horizontal period=64% or less.

Next, the luminescence duty of the display device having the drive blocks according to the present invention shall be calculated. Assuming that 1000 μS is required for a Vth detection period to have sufficient precision as in the above described condition, in the case of block driving, a period A (threshold voltage detection preparation period+threshold voltage detection period) shown in FIG. 4A is equivalent to the aforementioned 1000 μS. In this case, the non-luminescence production period for one frame becomes at least 1000 μS×2=2000 μS since the aforementioned period A and a storing period are included. Therefore, the luminescence duty of the display device having the drive blocks according to the present invention is (1 frame time−2000 μS)/1 frame time, and by substituting (1 sec./120 Hz) as the 1 frame time, is 76% or less.

According to the above comparison result, compared to the conventional image display device using two signal lines, combining block driving as in the present invention ensures a longer luminescence duty even when the same threshold voltage detection period is set. Therefore, it is possible to realize a display device that ensures sufficient luminescence luminance and has long operational life due to reduced output load on drive circuits.

Conversely, it is understood that when the same luminescence duty is set to the conventional image display device using two signal lines and the display device combining block driving as in the present invention, the display device according to the present invention ensures a longer threshold voltage detection period.

The driving method of the display device 1 according to the present embodiment shall be described once again.

Meanwhile, at a time t5, the correction of the threshold voltage of the drive transistors 114 in the (k+1)-th drive block begins.

First, immediately before the time t5, the voltage levels of the scanning lines 133 (*k*+1, 1) to 133 (*k*+1, *m*) are all HIGH, and the voltage level of the second control line 132 (*k*+1) is also HIGH. From the moment that the voltage level of the second control line 132 (*k*+1) is HIGH, the switching transistor 116 turns OFF. With this, the organic EL element 113 stops generating photons, and the concurrent generation of photons of the pixels in the (k+1)-th drive block ends. At the same time, the non-luminescence production period of the (k+1)-th drive block begins.

Next, at the time t5, the scanning/control line drive circuit 14 causes the voltage levels of the scanning lines 133 (*k*+1, 1) to 133 (*k*+1, *m*) to simultaneously change from HIGH to LOW so as to turn ON the switching transistor 115. Furthermore, at this time, the voltage level of the second control line 132 (*k*+1) is already at HIGH and the switching transistor 116 is already OFF, and the signal line drive circuit 15 causes the signal voltage of the second signal line 152 to change from the luminance signal voltage to the reference voltage (S21 in FIG. 6). With this, all of the pixels belonging to the (k+1)-th drive block are reset through the application of the reference voltage VR to the gate of the drive transistor 114. The operation of applying the aforementioned reference voltage to the gate of the drive transistor 114 corresponds to the simultaneous applying of the reference voltage in the (k+1)-th drive block.

Next, at a time t6, the scanning/control line drive circuit 14 causes the voltage level of the third control line 134 (*k*+1, 1) to change from LOW to HIGH (S22 in FIG. 6).

Through the changing of the voltage level of the third control line 134 (*k*+1) from LOW to HIGH, ΔV is set in advance to Vgs which is the gate-source voltage of the drive transistor 114 so that a voltage higher than the threshold voltage Vth of the drive transistor 114 is generated therein. Specifically, the potential difference generated in the electrostatic storing capacitor 118 is set to be a potential difference which allows for the detection of threshold voltage, thereby completing the preparation for the threshold voltage detection process. The above-described operation of causing the voltage level of the third control line 134 (*k*+1) by as much as ΔV corresponds to the simultaneous applying of the initializing voltage in the (k+1)-th drive block.

At this time, since the voltage level of the second control line 132 (*k*+1) is maintained at HIGH, there is no supply of current from the positive power source line 110 to the drive transistor 114, and the discharge current corresponding to the voltage stored in the electrostatic storing capacitor 118 begins to flow to the drive transistor 114 and the organic EL element 113.

As described thus far, in the period from the time t6 to a time t7, the correction of the threshold voltage Vth of the drive transistor 114 is executed simultaneously in the (k+1)-th drive block, and a voltage corresponding to the threshold voltage Vth of the drive transistor 114 is stored simultaneously in the respective electrostatic storing capacitors 118 of all the pixels 11B in the (k+1)-th drive block.

Next, at the time t7, the scanning/control line drive circuit 14 causes the voltage levels of the scanning lines 133 (*k*+1, 1) to 133 (*k*+1, *m*) to simultaneously change from LOW to HIGH so as to turn OFF the switching transistor 115 (S23 in FIG. 6). This completes the threshold voltage detection operation of the pixels belonging to the (k+1)-th drive block. The above-described operation of turning OFF the switching transistor 115 to stop the supply of the reference voltage to the gate of the drive transistor 114 corresponds to the simultaneous causing of the non-conduction in the (k+1)-th drive block.

The above-described simultaneous applying of the reference voltage in the (k+1)-th drive block, the simultaneous applying of the initializing voltage in the (k+1)-th drive block, and the simultaneous causing of the non-conduction in the (k+1)-th drive block correspond to the storing of a voltage (corresponding to the threshold voltage of a corresponding drive transistor) in a (k+1)-th drive block.

Next, in a period from a time t8 and a time t9, the scanning/control line drive circuit 14 causes the voltage levels of the scanning lines 133 (*k*+1, 1) to 133 (*k*+1, *m*) to sequentially change from HIGH to LOW to HIGH so as to sequentially turn ON the switching transistors 115 on a per pixel row basis. Furthermore, at this time, the signal line drive circuit 15 causes the signal voltage of the second signal line 152 to change from the reference voltage VR to the luminance signal voltage Vdata (S24 in FIG. 6). With this, the luminance signal voltage Vdata is applied to the gate of the drive transistor 114. At this time, a summed voltage obtained by adding a voltage corresponding to this luminance signal voltage Vdata and the voltage equivalent to the previously stored threshold voltage Vth of the drive transistor 114 is stored into the electrostatic storing capacitor 118. The above-described operation of storing the summed voltage corresponds to the storing of a summed voltage in the (k+1)-th drive block.

As described thus far, in a period from the time t8 to the time t9, the storing of the corrected luminance signal voltage is sequentially executed in the (K+1)-th drive block on a per pixel row basis.

Next, at the time t9, the scanning/control line drive circuit 14 causes the voltage level of the first control line 131 (*k*+1) to change from HIGH to LOW. Furthermore, almost simultaneously, the scanning/control line drive circuit 14 causes the voltage levels of the second control line 132 (*k*+1) and the third control line 134 (*k*+1) to changed from HIGH to LOW (S25 in FIG. 6). With this, a drive current corresponding to the aforementioned summed voltage flows to the organic EL element 113. In other words, generation of photons begins concurrently in all the pixels 11B in the (k+1)-th drive block. The above-described photon generation operation corresponds to the generating of the photons in the (k+1)-th drive block.

As described thus far, in a period from the time t9 onward, the generation of photons by the organic EL elements 113 is executed simultaneously in the (k+1)-th drive block.

The operations described thus far are also executed sequentially in the (k+2)-th drive block onward in the display panel 10.

Figure 4B:
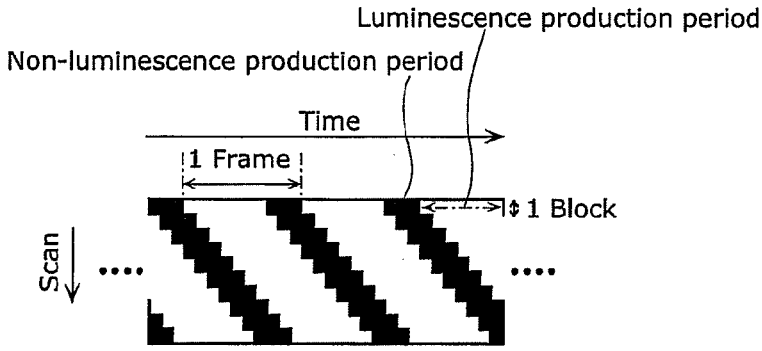
FIG. 4B is a state transition diagram of a drive block which generates photons according to the driving method according to the first embodiment of the present invention.

FIG. 4B is a state transition diagram of a drive block which generates photons according to the driving method according to the first embodiment of the present invention. In the figure, the luminescence production periods and the non-luminescence production periods of each drive block in a certain pixel column is shown. Plural drive blocks are shown in the vertical direction, and the horizontal axis shows time. Here, the non-luminescence production period includes the above-described threshold voltage correction period and the luminance signal voltage storing period.

According to the driving method of the display device according to the first embodiment of the present invention, luminescence production periods are concurrently set in the same drive block. Therefore, among the drive blocks, the luminescence production periods appear in a staircase pattern with respect to the row scanning direction.

As described thus far, the drive transistor 114 threshold voltage correction periods as well as the timings thereof can be made uniform within the same drive block through the pixel circuits in which the switching transistors 116 and 117 and the electrostatic storing capacitor 119 are provided, the arrangement of the control lines, scanning lines, and signal lines to the respective pixels that are formed into drive blocks, and the above-described driving method. In addition, the luminescence production periods as well as the timings thereof can be made uniform within the same drive block. Therefore, the load on the scanning/control line drive circuit 14 which outputs signals for controlling the conductive state and non-conductive state of respective switching transistors and signals for controlling current paths, and on the signal line drive circuit 15 which controls signal voltages is decreased. In addition, through the above-described forming of drive blocks and the two signal lines arranged for every pixel column, the drive transistor 114 threshold voltage correction period can take a large part of a 1 frame period Tf which is the time in which all the pixels are refreshed. This is because the threshold voltage correction period is provided in the (k+1)-th drive block in the period in which the luminance signal is to sampled in the k-th drive block. Therefore, the threshold voltage correction period is not divided on a per pixel row basis, but is divided on a per drive block basis. Thus, even when the display area is increased, a long relative threshold voltage correction period with respect to a 1 frame period can be set without a significant increase in the number of outputs of the scanning/control line drive circuit 14 and without reducing luminescence duty. With this, a drive current based on luminance signal voltage that has been corrected with a high degree of precision flows to the luminescence elements, and thus display quality improves.

For example, in the case where the display panel 10 is divided into N drive blocks, the threshold voltage correction period allocated to each pixel is at most Tf/N. Here, the threshold voltage correction period in the present invention is made up of a reset period and the threshold voltage detection period in the timing chart shown in FIG. 4A. In contrast, in the case where the threshold voltage correction period is set at a different timing for each of the pixel rows, and it is assumed that there are M rows of pixel rows (M≧≧N), threshold voltage correction period allocated to each pixel is at most Tf/M. Furthermore, even in the case where two signal lines are disposed for each pixel column as disclosed in Patent Reference 1, threshold voltage correction period allocated to each pixel is at most 2Tf/M.

Furthermore, by forming drive blocks, the first control line for controlling the conduction between the source of the drive transistor 114 and the electrostatic storing capacitor 118, the second control line for controlling the turning ON and OFF of the voltage application to the drive transistor 114, and the third control line for controlling the potential of the second electrode of the electrostatic storing capacitor 118 can be shared within a drive block. Therefore, the number of control lines outputted from the scanning/control line drive circuit 14 is reduced. Therefore, the load on the drive circuit is decreased.

For example, in the conventional image display device 500 disclosed in Patent Reference 1, two control lines (power supply line and scanning line) are disposed per pixel row. Assuming that the image display device 500 includes M rows of pixel rows, the control lines would total 2M lines.

In contrast, in the display device 1 according to the first embodiment of the present invention, one signal line per pixel row and three control lines per drive block are outputted from the scanning/control line drive circuit 14. Therefore, assuming that the display device 1 includes M rows of pixel rows, the control lines (including scanning lines) would total (M+3N) lines.

Since M>>N is realized in the case of a large surface area and a large number of rows of pixels, in such case, the number of control lines in the display device 1 according to the present invention can be reduced to approximately half compared to the number of control lines in the conventional image display device 500.

(Second Embodiment)

Hereinafter, a second embodiment of the present invention shall be described with reference to the Drawings.

Figure 8:
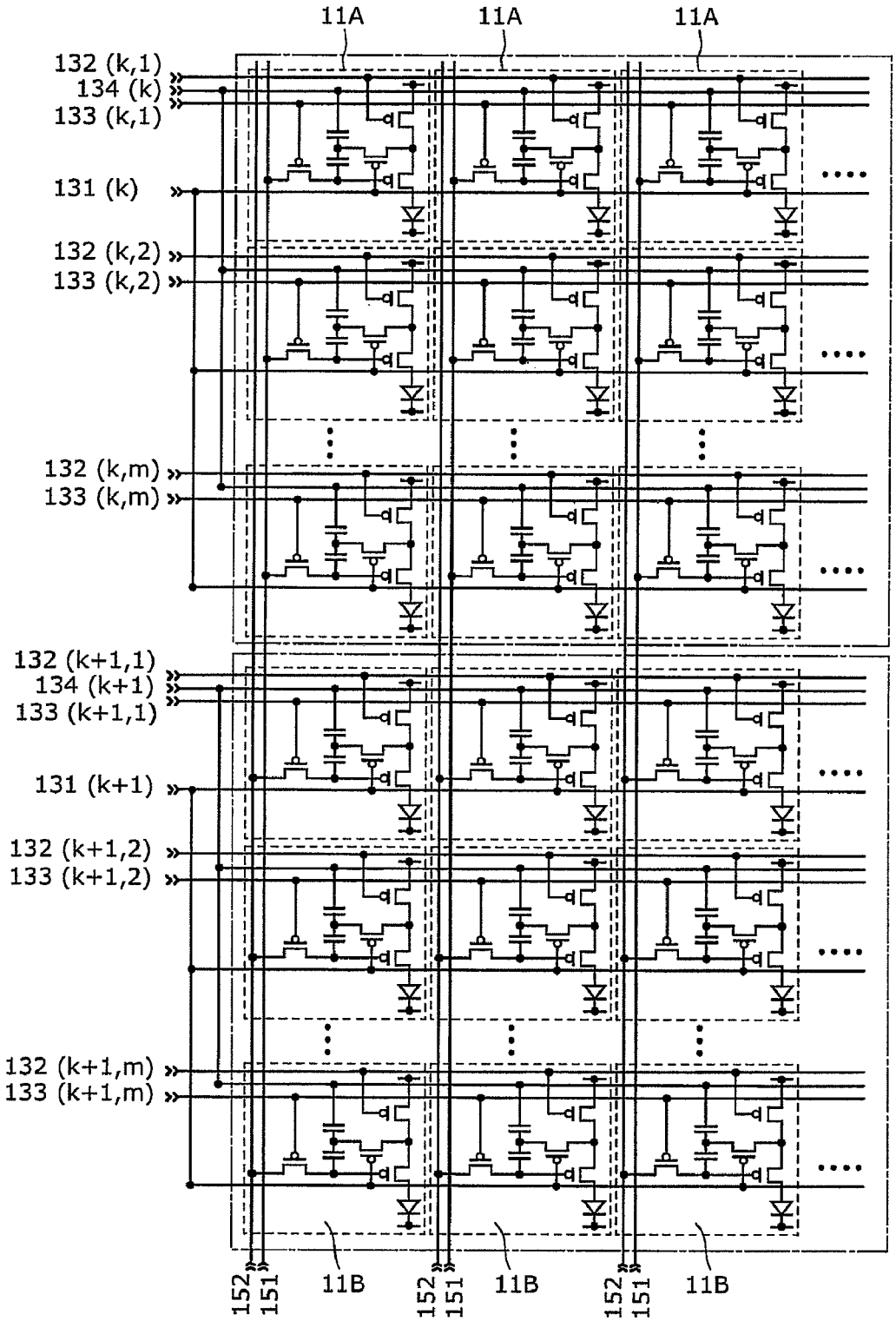
FIG. 8 is a circuit configuration diagram showing part of a display panel included in a display device according to a second embodiment of the present invention.

FIG. 8 is a circuit configuration diagram showing part of a display panel included in a display device according to the second embodiment of the present invention. The figure shows two adjacent drive blocks and respective control lines, respective scanning lines, and respective signal lines. In the figure and the subsequent description, the respective control lines, respective scanning lines, and respective signal lines shall be represented by "reference number (block number; row number of the block)" or "reference number (block number)".

Compared to the display device 1 shown in FIG. 3, the display device shown in the figure has the same circuit configuration for the respective pixels but is different in that the second control line 132 is not shared on a drive block basis and is connected on a per pixel row basis to the scanning/control line drive circuit 14 not shown in the figure. Description of points that are the same as in the display device according to the first embodiment shown in FIG. 3 shall be omitted, and only the points of difference shall be described hereafter.

In the k-th drive block shown at the top stage of FIG. 8, each of the second control lines 132 (*k*, 1) to 132 (*k, m*) are disposed to a corresponding one of the pixel rows in the drive block and is separately connected to the gates of the respective switching transistors 116 included in the corresponding pixels 11A in the drive block. Furthermore, the first control line 131 (*k*) is connected in common to the gates of the respective switching transistors 117 included in all the pixels 11A in the drive block. Furthermore, the third control line 134 (*k*) is connected in common to the respective electrostatic storing capacitors 119 included in all the pixels 11A in the drive block. Meanwhile, each of the scanning lines 133 (*k*, 1) to 133 (*k, m*) are separately connected on a per pixel row basis. Furthermore, the same connections as those in the k-th drive block are also carried out on the (k+1)-th drive block shown in the bottom stage of FIG. 8. However, the first control line 131 (*k*) connected to the k-th drive block and the first control line 131 (*k*+1) connected to the (k+1)-th drive block are different control lines, and separate control signals are outputted from the scanning/control line drive circuit 14. Furthermore, the third control line 134 (*k*) connected to the k-th drive block and the third control line 134 (*k*+1) connected to the (k+1)-th drive block are different control lines, and separate control signals are outputted from the scanning/control line drive circuit 14.

Furthermore, in the k-th drive block, the first signal line 151 is connected to the other of the source and drain of the respective switching transistors 115 included in all of the pixels 11A in the drive block. Meanwhile, in the (k+1)-th drive block, the second signal line 152 is connected to the other of the source and drain of the respective switching transistors 115 included in all of the pixels 11B in the drive block.

With the above-described formation of drive blocks, the number of first control lines 131 and third control lines 134 for controlling the respective Vth detection circuits is reduced. Therefore, the load on the scanning/control line drive circuit 14 which outputs drive signals to these control lines is reduced.

Figure 9A:
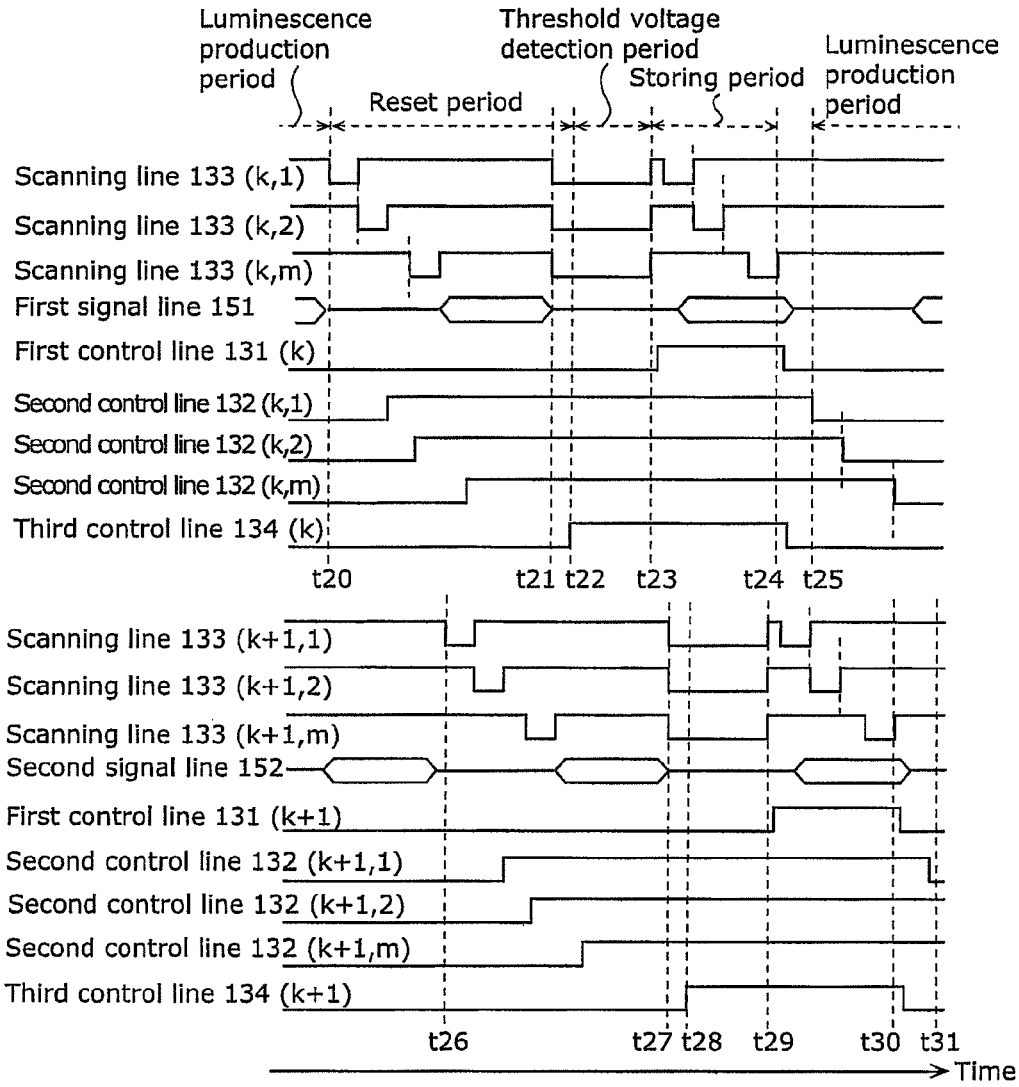
FIG. 9A is an operation timing chart for driving method of the display device in the second embodiment of the present invention.

Next, the driving method of the display device according to the present embodiment shall be described using FIG. 9A.

FIG. 9A is an operation timing chart for the driving method of the display device in the second embodiment of the present invention. In the figure, the horizontal axis denotes time. Furthermore, in the vertical direction, the waveform diagrams of the voltage generated in the scanning lines 133 (*k*, 1), 133 (*k*, 2), and 133 (*k, m*), the first signal line 151, the first control line 131 (*k*), the second control lines 132 (*k*, 1), 132 (*k*, 2), and 132 (*k, m*), and the third control line 134 (k) of the k-th drive block are shown in sequence from the top. Furthermore, continuing therefrom, the waveform diagrams of the voltage generated in the scanning lines 133 (*k*+1, 1), 133 (*k*+1, 2), and 133 (*k*+1, *m*), the second signal line 152, the first control line 131 (*k*+1), the second control lines 132 (*k*+1, 1), 132 (*k*+1, 2), and 132 (*k*+1, *m*), and the third control line 134 (*k*+1) of the (k+1)-th drive block are shown.

Compared to the driving method according to the first embodiment shown in FIG. 4A, the driving method according to the present embodiment is different only in that the signal voltage storing periods as well as the luminescence production periods are set on a per pixel row basis, without the luminescence production periods being made uniform within a drive block.

First, at a time t20, the scanning/control line drive circuit 14 causes the voltage level of the scanning line 133 (*k*, 1) to change from HIGH to LOW so as to turn ON the switching transistor 115. Furthermore, at this time, the signal line drive circuit 15 causes the voltage of the first signal line 151 to change from the luminance signal voltage Vdata to the reference voltage VR. With this, the pixels belonging to the first row of the k-th drive block stop generating photons. Subsequently, the scanning/control line drive circuit 14 sequentially causes the voltage levels of the scanning lines 133 (*k*, 1) to 133 (*k, m*) to change from HIGH to LOW so that the pixels belonging to the k-th drive block stop generating photons, row-by-row sequentially.

Furthermore, between the time t20 and a time t21, the scanning/control line drive circuit 14 causes the voltage levels of the second control lines 132 (*k*, 1) to 132 (*k, m*) to sequentially change from LOW to HIGH so as to place the drive transistor 114 and the power source line 110 in the non-conductive state. This stops the supply of the power source voltage to the drive transistor 114 of the pixels belonging to the k-th drive block.

Next, at the time t21, the scanning/control line drive circuit 14 causes the voltage levels of the scanning lines 133 (*k*, 1) to 133 (*k, m*) to simultaneously change from HIGH to LOW so as to turn ON the switching transistor 115. Furthermore, at this time, the voltage level of the second control lines 132 (*k*, 1) to 132 (*k, m*) is already at HIGH and the switching transistor 116 is already OFF. Furthermore, at this time, the voltage level of the first control line 131 (*k*) is already at LOW and the switching transistor 117 is already ON. In addition, the signal line drive circuit 15 causes the voltage of the first signal line 151 to change from the luminance signal voltage to the reference voltage (S11 in FIG. 6). With this, the reference signal voltage is applied to the gate of the drive transistor 114. The operation of applying the aforementioned reference voltage to the gate of the drive transistor 114 corresponds to the simultaneous applying of the reference voltage in the k-th drive block.

Next, at a time t22, the scanning/control line drive circuit 14 causes the voltage level of the third control line 134 (*k*) to change from LOW to HIGH (S12 in FIG. 6). At this time, when the voltage level of the third control line 134 (*k*) is caused to change by as much as ΔV, the potential of the second electrode of electrostatic storing capacitor 118 rises by as much as a voltage distributed according to the capacitance ratio between the electrostatic storing capacitor 118 and the electrostatic storing capacitor 119.

Through the changing of the voltage level of the third control line 134 (*k*) from LOW to HIGH, ΔV is set in advance to Vgs which is the gate-source voltage of the drive transistor 114 so that a voltage higher than the threshold voltage Vth of the drive transistor 114 is generated therein. Specifically, the potential difference generated in the electrostatic storing capacitor 118 is set to be a potential difference which allows for the detection of threshold voltage, thereby completing the preparation for the threshold voltage detection process. The above-described operation of causing the voltage level of the third control line 134 (*k*) by as much as ΔW corresponds to the simultaneous applying of the initializing voltage in the k-th drive block.

At this time, since the voltage levels of the second control lines 132 (*k*, 1) to 132 (*k, m*) are maintained at HIGH, there is no supply of current from the power source line 110 to the drive transistor 114, and the discharge current corresponding to the voltage stored in the electrostatic storing capacitor 118 begins to flow to the drive transistor 114 and the organic EL element 113.

Between the time t22 and a time t23, the voltage stored in the electrostatic storing capacitor 118 becomes asymptotic to the threshold voltage Vth of the drive transistor 114, due to such discharge current.

Then, when the voltage stored in the electrostatic storing capacitor 118 becomes the threshold voltage Vth of the drive transistor 114, the discharge current stops.

It should be noted that, since the flowing discharge current for causing the voltage equivalent to the threshold voltage Vth to be stored in the electrostatic storing capacitor 118 is minute, it takes time for the voltage stored in the electrostatic storing capacitor 118 to become asymptotic to the threshold voltage Vth of the drive transistor 114 and reach the steady state. Therefore, the longer this period is, the more stable the voltage stored in the electrostatic storing capacitor 118 becomes, and by ensuring that this period is sufficiently long, voltage compensation having high-precision is realized.

As described thus far, in the period from the time t22 to the time t23, the correction of the threshold voltage Vth of the drive transistor 114 is executed simultaneously in the k-th drive block, and a voltage corresponding to the threshold voltage Vth of the drive transistor 114 is stored simultaneously in the respective electrostatic storing capacitors 118 of all the pixels 11A in the k-th drive block.

Next, at the time t23, the scanning/control line drive circuit 14 causes the voltage levels of the scanning lines 133 (*k*, 1) to 133 (*k, m*) to simultaneously change from LOW to HIGH so as to turn OFF the switching transistor 115 (S13 in FIG. 6). This completes the threshold voltage detection operation of the pixels belonging to the k-th drive block. The above-described operation of turning OFF the switching transistor 115 to stop the supply of the reference voltage to the gate of the drive transistor 114 corresponds to the simultaneous causing of the non-conduction in the k-th drive block.

The above-described simultaneous applying of the reference voltage in the k-th drive block, the simultaneous applying of the initializing voltage in the k-th drive block, and the simultaneous causing of the non-conduction in the k-th drive block correspond to the storing of the voltage (corresponding to the threshold voltage of a corresponding drive transistor) in the k-th drive block.

Next, in a period from the time t24 to the time t24, the scanning/control line drive circuit 14 causes the voltage level of the first control line 131 (*k*) to change from LOW to HIGH so as to turn OFF the switching transistor 117. This completes the preparation for storing the luminance signal voltage to the pixels belonging to the k-th drive block. Because the switching transistor 117 is OFF during the luminance signal voltage storing period, the current path between the second electrode of the electrostatic storing capacitor 118 and the source of the drive transistor 114 is blocked. Therefore, during the storing period, the discharge current from the electrostatic storing capacitor 118 to the drive transistor 114 does not flow, and an accurate voltage corresponding to the luminance signal voltage is stored in the electrostatic storing capacitor 118. Furthermore, since such period does not require high-speed storing for controlling the leak current, the ideal storing period necessary for storing an accurate luminance signal voltage can be secured.

Subsequently, during the time t23 to the time t24, the scanning/control line drive circuit 14 causes the voltage levels of the scanning lines 133 (*k*, 1) to 133 (*k, m*) to sequentially change from HIGH to LOW to HIGH so as to sequentially turn ON the switching transistors 115 on a per pixel row basis. Furthermore, at this time, the signal line drive circuit 15 causes the signal voltage of the first signal line 151 to change from the reference voltage VR to the luminance signal voltage Vdata (S14 in FIG. 6). With this, the luminance signal voltage Vdata is applied to the gate of the drive transistor 114. At this time, a summed voltage obtained by adding a voltage corresponding to this luminance signal voltage Vdata and the voltage equivalent to the previously stored threshold voltage Vth of the drive transistor 114 is stored into the electrostatic storing capacitor 118. The above-described operation of storing the summed voltage corresponds to the storing of a summed voltage in the k-th drive block.

As described thus far, in a period from the time t23 to the time t24, the storing of the corrected luminance signal voltage is sequentially executed in the k-th drive block on a per pixel row basis.

Next, at the time t24, the scanning/control line drive circuit 14 causes the voltage level of the first control line 131 (*k*) to change from HIGH to LOW. Furthermore, almost simultaneously, the scanning/control line drive circuit 14 causes the voltage level of the third control line 134 (*k*) to change from HIGH to LOW. With this, preparation for causing a drive current corresponding to the summed voltage to flow to the organic EL element 113 is completed.

Next, from a time t25 onward, the scanning/control line drive circuit 14 causes the voltage levels of the second control lines 132 (*k*, 1) to 132 (*k, m*) to change, row-by-row sequentially, from HIGH to LOW (S15 in FIG. 6). With this, the drive current corresponding to the summed voltage flows on a per pixel row basis to the organic EL element 113 in all the pixels 11A in the k-th drive block, and photon generation begins. The above-described photon generation operation corresponds to the generating of the photons in the k-th drive block.

As described thus far, by forming the pixel rows into drive blocks, the correction of the threshold voltage Vth of the drive transistors 114 is executed simultaneously in the respective drive blocks. Furthermore, the generation of photons by the organic EL elements 113 is executed simultaneously in the respective drive blocks. With this, the control for turning the drive current of the drive transistors 1140N and OFF can be synchronized in the respective drive blocks. Therefore, the first control line 131, the second control line 132, and the third control line 134 can be shared in each of the drive blocks.

As described thus far, from the time t25 onward, photon generation corresponding to the corrected luminance signal voltage is sequentially executed in the k-th drive block on a per pixel row basis. Here, the drain current $i_d$ flowing in the drive transistor 114 is defined by Expression 8, using a voltage value obtained by deducting the threshold voltage Vth of the drive transistor 114 from the Vgs defined in Expression 7 in the first embodiment. It can be seen from Expression 8 that the drain current $i_d$ for causing the organic EL element 113 to generate photons is a current that is not dependent on the threshold voltage Vth of the drive transistor 114.

As described thus far, by forming the pixel rows into drive blocks, the correction of the threshold voltage Vth of the drive transistors 114 is executed simultaneously in the respective drive blocks. With this, the first control line 131 and the third control line 134 can be shared in each of the drive blocks.

Furthermore, although the scanning lines 133 (*k*, 1) to 133 (*k*, *m*) are separately connected to the scanning/control line drive circuit 14, the timing of the drive pulse in the threshold voltage compensation period is the same. Therefore, the scanning/control line drive circuit 14 can suppress the rising of the frequency of the pulse signals to be outputted, and thus the output load on the drive circuit is decreased.

From the same perspective as the first embodiment, the present embodiment also has the advantage that luminescence duty can be secured longer compared to the conventional image display device using two signal lines.

Therefore, it is possible to realize a display device that ensures sufficient luminescence luminance and has long operational life due to reduced output load on drive circuits.

Furthermore, it is understood that when the same luminescence duty is set to the conventional image display device using two signal lines and the display device combining block driving as in the present invention, the display device according to the present invention ensures a longer threshold voltage detection time.

The driving method of the display device according to the present embodiment shall be described once again.

Meanwhile, at a time t28, the correction of the threshold voltage of the drive transistors 114 in the (k+1)-th drive block begins.

First, in a time t26 immediately following the completion of the stopping of photon generation of the pixels 11A belonging to the m-th row of the k-th drive block, the scanning/control line drive circuit 14 causes the voltage level of the scanning line 133 (*k*+1, 1) to change from HIGH to LOW so as to turn ON the switching transistor 115. Furthermore, at this time, the signal line drive circuit 15 causes the voltage of the second signal line 152 to change from the luminance signal voltage Vdata to the reference voltage VR. With this, the pixels belonging to the first row of the (k+1)-th drive block stop generating photons. Subsequently, the scanning/control line drive circuit 14 sequentially causes the voltage levels of the scanning lines 133 (*k*+1, 2) to 133 (*k*+1, *m*) to change from HIGH to LOW so that the pixels belonging to the (k+1)-th drive block stop generating photons, row-by-row sequentially.

Furthermore, between the time t26 and a time t27, the scanning/control line drive circuit 14 causes the voltage levels of the second control lines 132 (*k*+1, 1) to 132 (*k*+1, *m*) to sequentially change from LOW to HIGH so as to place the drive transistor 114 and the power source line 110 in the non-conductive state. This stops the supply of the power source voltage to the drive transistor 114 of the pixels belonging to the (k+1)-th drive block.

Next, in the time t27 immediately following the completion of the threshold voltage detection period for all the pixels 11A belonging to the k-th drive block, the scanning/control line drive circuit 14 causes the voltage levels of the scanning lines 133 (*k*+1, 1) to 133 (*k*+1, *m*) to simultaneously change from HIGH to LOW so as to turn ON the switching transistor 115. Furthermore, at this time, the voltage levels of the second control lines 132 (*k*+1, 1) to 132 (*k*+1, *m*) are already at HIGH and the switching transistor 116 is already OFF. Furthermore, at this time, the voltage level of the first control line 131 (k+1) is already at LOW and the switching transistor 117 is already ON. In addition, the signal line drive circuit 15 causes the voltage of the second signal line 152 to change from the luminance signal voltage to the reference voltage (S21 in F6). With this, the reference signal voltage is applied to the gate of the drive transistor 114. The operation of applying the aforementioned reference voltage to the gate of the drive transistor 114 corresponds to the simultaneous applying of the reference voltage in the (k+1)-th drive block.

Next, at a time t28, the scanning/control line drive circuit 14 causes the voltage level of the third control line 134 (*k*+1) to change from LOW to HIGH (S32 in FIG. 6). At this time, when the voltage level of the third control line 134 (*k*+1) is caused to change by as much as ΔV, the potential of the second electrode of electrostatic storing capacitor 118 rises by as much as a voltage distributed according to the capacitance ratio between the electrostatic storing capacitor 118 and the electrostatic storing capacitor 119.

Through the changing of the voltage level of the third control line 134 (*k*+1) from LOW to HIGH, ΔV is set in advance to Vgs which is the gate-source voltage of the drive transistor 114 so that a voltage higher than the threshold voltage Vth of the drive transistor 114 is generated therein. Specifically, the potential difference generated in the electrostatic storing capacitor 118 is set to be a potential difference which allows for the detection of threshold voltage, thereby completing the preparation for the threshold voltage detection process. The above-described operation of causing the voltage level of the third control line 134 (*k*+1) by as much as ΔV corresponds to the simultaneous applying of the initializing voltage in the (k+1)-th drive block.

At this time, since the voltage levels of the second control lines 132 (*k*+1, 1) to 132 (*k*+1, *m*) are maintained at HIGH, there is no supply of current from the power source line 110 to the drive transistor 114, and the discharge current corresponding to the voltage stored in the electrostatic storing capacitor 118 begins to flow to the drive transistor 114 and the organic EL element 113.

Between the time t28 and a time t29, the voltage stored in the electrostatic storing capacitor 118 becomes asymptotic to the threshold voltage Vth of the drive transistor 114, due to such discharge current.

Then, when the voltage stored in the electrostatic storing capacitor 118 becomes the threshold voltage Vth of the drive transistor 114, the discharge current stops.

As described thus far, in the period from the time t28 to the time t29, the correction of the threshold voltage Vth of the drive transistor 114 is executed simultaneously in the (k+1)-th drive block, and a voltage corresponding to the threshold voltage Vth of the drive transistor 114 is stored simultaneously in the respective electrostatic storing capacitors 118 of all the pixels 11B in the (k+1)-th drive block.

Next, at the time t29, the scanning/control line drive circuit 14 causes the voltage levels of the scanning lines 133 (*k*+1, 1) to 133 (*k*+1, *m*) to simultaneously change from LOW to HIGH so as to turn OFF the switching transistor 115 (S23 in FIG. 6). This completes the threshold voltage detection operation of the pixels belonging to the (k+1)-th drive block. The above-described operation of turning OFF the switching transistor 115 to stop the supply of the reference voltage to the gate of the drive transistor 114 corresponds to the simultaneous causing of the non-conduction in the (k+1)-th drive block.

The above-described simultaneous applying of the reference voltage in the (k+1)-th drive block, the simultaneous applying of the initializing voltage in the (k+1)-th drive block, and the simultaneous causing of the non-conduction in the (k+1)-th drive block correspond to the storing of the voltage (corresponding to the threshold voltage of a corresponding drive transistor) in the (k+1)-th drive block.

Next, in a period from the time t29 to a time t30, the scanning/control line drive circuit 14 causes the voltage level of the first control line 131 (*k*+1) to change from LOW to HIGH so as to turn OFF the switching transistor 117. This completes the preparation for storing the luminance signal voltage to the pixels belonging to the (k+1)-th drive block. Because the switching transistor 117 is OFF during the luminance signal voltage storing period, the current path between the second electrode of the electrostatic storing capacitor 118 and the source of the drive transistor 114 is blocked. Therefore, during the storing period, the discharge current from the electrostatic storing capacitor 118 to the drive transistor 114 does not flow, and an accurate voltage corresponding to the luminance signal voltage is stored in the electrostatic storing capacitor 118.

Subsequently, during the time t29 to the time t30, the scanning/control line drive circuit 14 causes the voltage levels of the scanning lines 133 (*k*+1, 1) to 133 (*k*+1, *m*) to sequentially change from HIGH to LOW to HIGH so as to sequentially turn ON the switching transistors 115 on a per pixel row basis. Furthermore, at this time, the signal line drive circuit 15 causes the signal voltage of the second signal line 152 to change from the reference voltage VR to the luminance signal voltage Vdata (S24 in FIG. 6). With this, the luminance signal voltage Vdata is applied to the gate of the drive transistor 114. At this time, a summed voltage obtained by adding a voltage corresponding to this luminance signal voltage Vdata and the voltage equivalent to the previously stored threshold voltage Vth of the drive transistor 114 is stored into the electrostatic storing capacitor 118. The above-described operation of storing the summed voltage corresponds to the storing of a summed value in the (k+1)-th drive block.

As described thus far, in a period from the time t29 to the time t30, the storing of the corrected luminance signal voltage is sequentially executed in the (K+1)-th drive block on a per pixel row basis.

Next, at the time t30, the scanning/control line drive circuit 14 causes the voltage level of the first control line 131 (*k*+1) to change from HIGH to LOW. Furthermore, almost simultaneously, the scanning/control line drive circuit 14 causes the voltage level of the third control line 134 (*k*+1) to change from HIGH to LOW. With this, preparation for causing a drive current corresponding to the summed voltage to flow to the organic EL element 113 is completed.

Next, from a time t31 onward, the scanning/control line drive circuit 14 causes the voltage levels of the second control lines 132 (k+1, 1) to 132 (*k*+1, *m*) to change, row-by-row sequentially, from HIGH to LOW (S25 in FIG. 6). With this, the drive current corresponding to the summed voltage flows on a per pixel row basis to the organic EL element 113 in all the pixels 11B in the (k+1)-th drive block, and photon generation begins. The above-described photon generation operation corresponds to the generating of the photons in the (k+1)-th drive block.

As described thus far, from the time t31 onward, photon generation corresponding to the corrected luminance signal voltage is sequentially executed in the (k+1)-th drive block on a per pixel row basis.

The operations described thus far are also executed sequentially in the (k+2)-th drive block onward in the display panel 10.

Figure 9B:
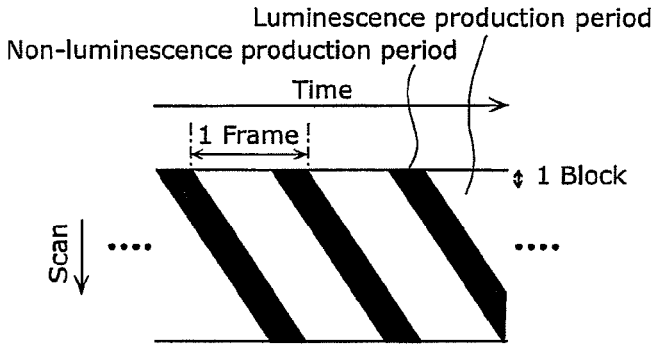
FIG. 9B is a state transition diagram of a drive block which generates photons according to the driving method according to the second embodiment of the present invention.

FIG. 9B is a state transition diagram of a drive block which generates photons according to the driving method according to the second embodiment of the present invention. In the figure, the luminescence production periods and the non-luminescence production periods of each drive block in a certain pixel column is shown. Plural drive blocks are shown in the vertical direction, and the horizontal axis shows time. Here, the non-luminescence production period includes the above-described threshold voltage correction period.

According to the driving method of the display device according to the second embodiment of the present invention, luminescence production periods are sequentially set on a per pixel row basis even within the same drive block. Therefore, even within a drive block, the luminescence production periods appear in a continuous manner with respect to the row scanning direction.

Thus, the drive transistor 114 threshold voltage correction periods as well as the timings thereof can also be made uniform within the same drive block in the second embodiment through the pixel circuit provided with the switching transistors 116 and 117 and the electrostatic storing capacitor 119, and through the arrangement of control lines, scanning lines, and signal lines to the respective pixels that have been formed into drive blocks. Therefore, the load on the scanning/control line drive circuit 14 which outputs signals for controlling current paths, and on the signal line drive circuit 15 which controls signal voltages is decreased. In addition, through the above-described forming of drive blocks and the two signal lines arranged for every pixel column, the drive transistor 114 threshold voltage correction period can take a large part of a 1 frame period Tf which is the time in which all the pixels are refreshed. This is because the threshold voltage correction period is provided in the (k+1)-th drive block in the period in which the luminance signal is sampled in the k-th drive block. Therefore, the threshold voltage correction period is not divided on a per pixel row basis, but is divided on a per drive block basis. Therefore, as the display area is increased, a long relative threshold voltage correction period can be set with respect to 1 frame period, without allowing luminescence duty to decrease with the increase in the display area. With this, a drive current based on luminance signal voltage that has been corrected with a high degree of precision flows to the luminescence elements, and thus image display quality improves.

For example, in the case where the display panel 10 is divided into N drive blocks, the threshold voltage correction period allocated to each pixel is at most Tf/N.

(Third Embodiment)

Hereinafter, a third embodiment of the present invention shall be described with reference to the Drawings.

Figure 10A:
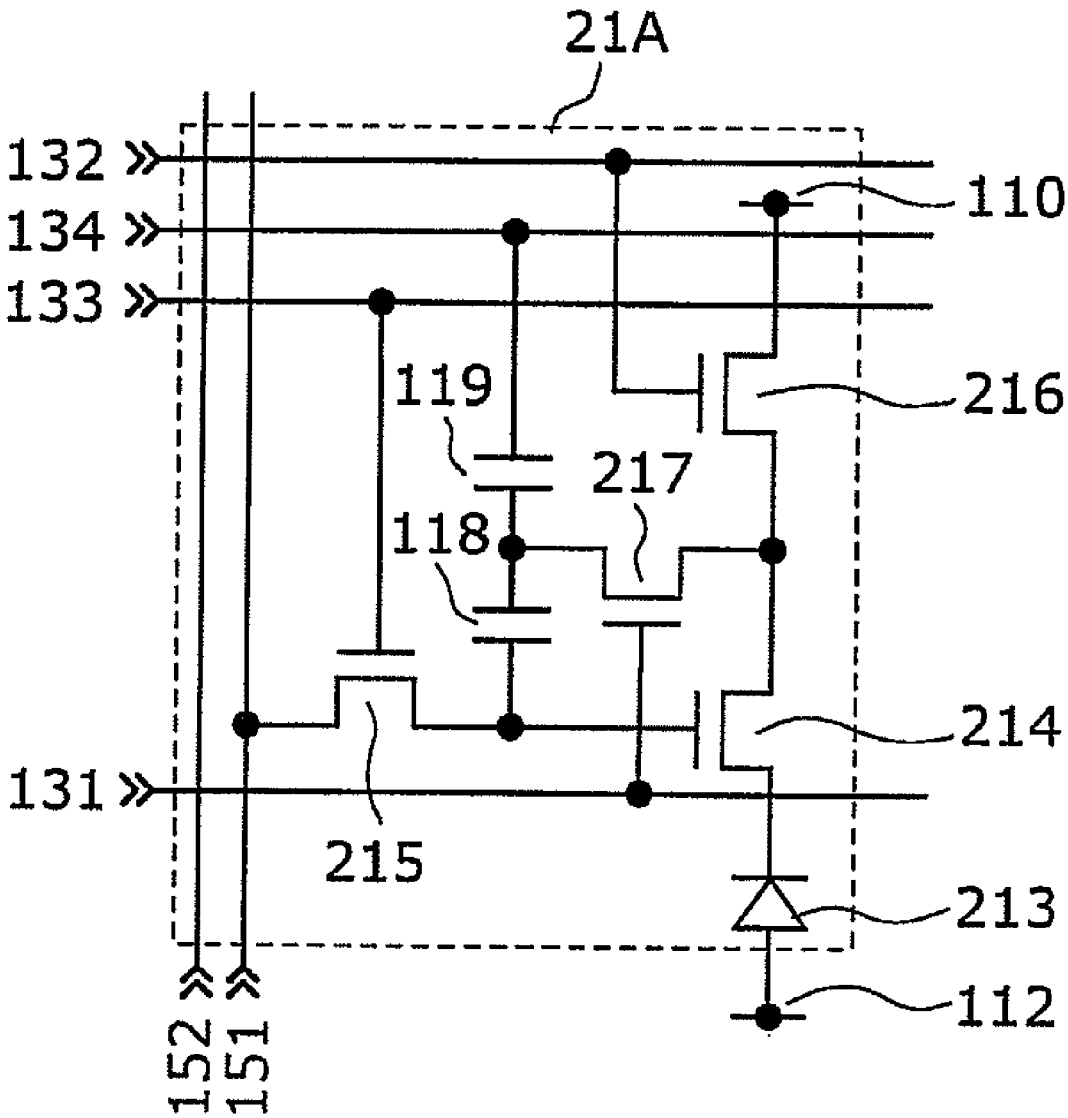
FIG. 10A is a specific circuit configuration diagram of a pixel of an odd drive block in a display device according to the third embodiment of the present invention.
Figure 10B:
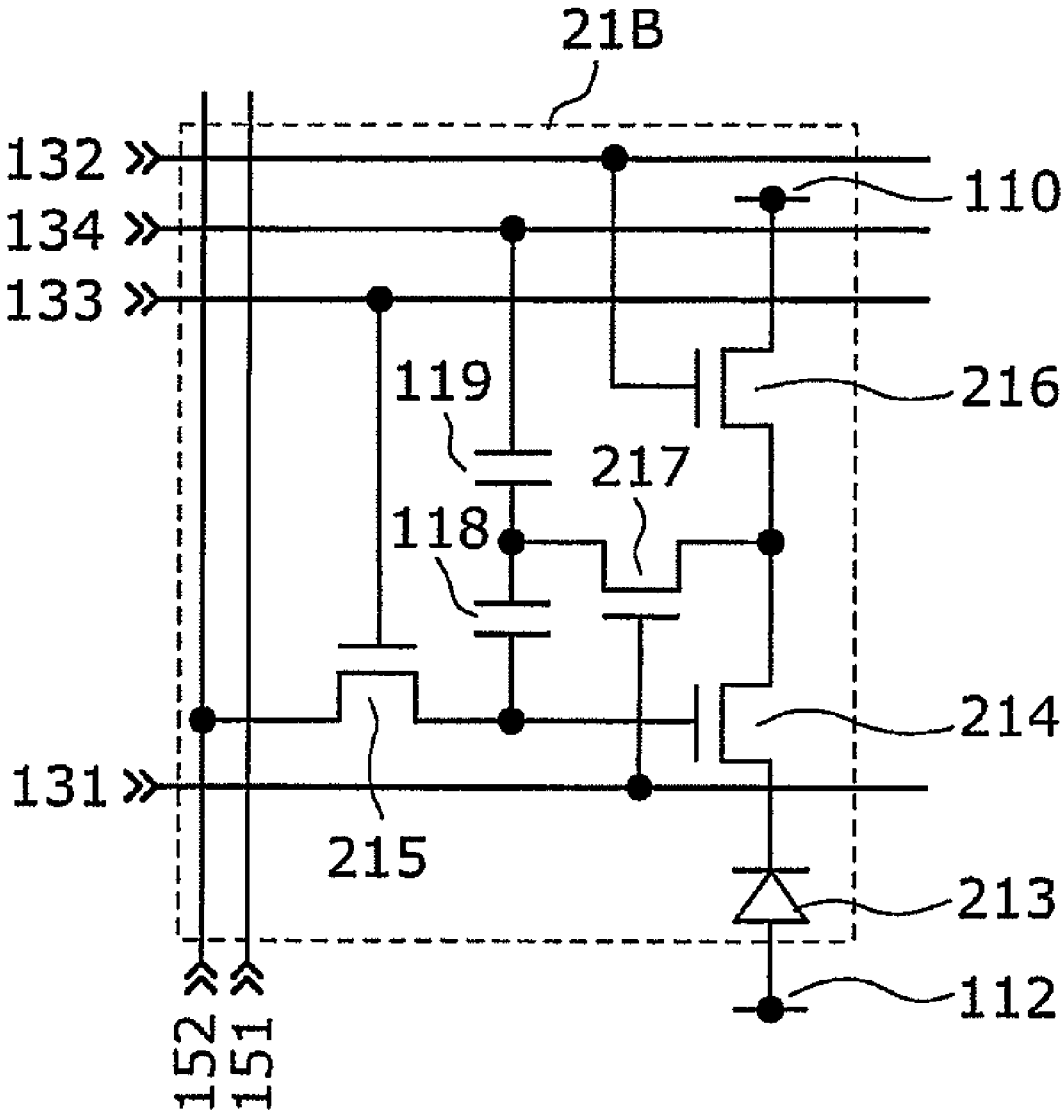
FIG. 10B is a specific circuit configuration diagram of a pixel of an even drive block in a display device according to the third embodiment of the present invention.

FIG. 10A is a specific circuit configuration diagram of a pixel of an odd drive block in a display device according to the third embodiment of the present invention, and FIG. 10B is a specific circuit configuration diagram of a pixel of an even drive block in a display device according to the third embodiment of the present invention Each of the pixels 21A and 21B shown in FIG. 10A and FIG. 10B, respectively, include: an organic electroluminescence (EL) element 213; a drive transistor 214; switching transistors 215, 216, and 217; the electrostatic storing capacitors 118 and 119, the first control line 131; the second control line 132; the scanning line 133; the third control line 134, the first signal line 151; and the second signal line 152.

Compared to the pixels 11A and 11B shown in FIG. 2A and FIG. 2B, the pixels 21A and 21B shown in the figures are different in that the respective transistors are of the N-type and the connection relationship for the terminals of the organic EL element 213 is reversed. The respective scanning lines, control lines, and signal lines are connected to the respective transistors and electrostatic storing capacitors in the same manner as the pixels 11A and 11B shown in FIG. 2A and FIG. 2B. Description of points identical to those in the first embodiment shall be omitted and only the points of difference shall be described hereafter.

In FIG. 10A and FIG. 10B, the organic EL element 213 is a luminescence element having an anode connected to the power source line 112, which is the second power source line, and a cathode connected to the drain of the drive transistor 214. The organic EL element 213 generates photons according to the flow of the drive current of the drive transistor 214.

The drive transistor 214 is a drive transistor having a source connected to one of the source and the drain of the switching transistor 116, and a drain connected to the cathode of the organic EL element 213. The drive transistor 214 converts a signal voltage applied between the gate and source into a drain current corresponding to such signal voltage. Subsequently, the drive transistor 214 supplies this drain current, as a drive current, to the organic EL element 213. The drive transistor 214 is configured of an N-type thin film transistor (N-type TFT).

The switching transistor 215 has a gate connected to the scanning line 133, and one of a source and a drain connected to the gate of the drive transistor 214. Furthermore, the other of the source and the drain is connected to the first signal line 151 and functions as a third switching transistor in the pixel 21A in the odd drive block. On the other hand, the other of the source and the drain is connected to the second signal line 152 and functions as a fourth switching transistor in the pixel 21B in the even drive block.

The switching transistor 216 is a second switching transistor having a gate connected to the second control line 132, and the other of a source and a drain connected to the power source line 110 which is the first power source line. The switching transistor 216 has a function of turning ON and OFF the drain current of the drive transistor 214.

It should be noted that it is sufficient that the source and the drain of the switching transistor 116 are connected between the power source line 110 and the source of the drive transistor 214. With this arrangement, the drain current of the drive transistor 214 can be turned ON and OFF.

The switching transistor 217 is a first switching transistor having a gate connected to the first control line 131, one of a source and a drain connected to the other of terminals of the electrostatic storing capacitor 118, and the other of the source and the drain connected to the source of the drive transistor 214. By turning OFF in the period for storing the signal voltage from the signal line, the switching transistor 217 has a function of causing a voltage corresponding to an accurate signal voltage to be stored in the electrostatic storing capacitor 118. Meanwhile, by turning ON in the threshold voltage detection period and the luminescence production period, the switching transistor 217 has a function of connecting the source of the drive transistor 214 to the electrostatic storing capacitors 118 and 119, causing a voltage corresponding to the threshold voltage and the signal voltage to be stored accurately in the electrostatic storing capacitor 118, and causing the drive transistor 214 to supply the luminescence element with a drive current reflecting the voltage stored in the electrostatic storing capacitor 118. Each of the switching transistors 215, 216, and 217 is configured of an N-type thin film transistor (N-type TFT).

The electrostatic storing capacitor 118 is a first capacitor element having a first electrode, which is one of its terminals, connected to the gate of the drive transistor 214 and a second electrode, which is the other of the terminals, connected to one of the source and the drain of the switching transistor 217. The electrostatic storing capacitor 118 has a function of storing a voltage corresponding to the signal voltage supplied from the first signal line 151 or the second signal line 152 and to the threshold voltage of the drive transistor 214, and controlling a signal current supplied from the drive transistor 214 to the organic EL element 213 after the switching transistor 215 is turned OFF for example.

The electrostatic storing capacitor 119 is a second capacitor element connected between the second electrode of the electrostatic storing capacitor 118 and the third control line 134. First, the electrostatic storing capacitor 119 stores the source potential of the drive transistor 214 in the steady state through the conduction of the switching transistor 217.

It should be noted that, although not shown in FIG. 10A and FIG. 10B, the power source line 110 and the power source line 112 are a negative power source line and a positive power source line, respectively, and each is also connected to other pixels and to a voltage source.

Furthermore, the inter-pixel connection relationship the first control line 131, the second control line 132, and the third control line 134 is the same as the connection relationship of the respective control lines shown in FIG. 3, with each being shared on a per drive block basis.

With the above-described formation of drive blocks, the number of first control lines 131 for controlling the connection between the source of the respective drive transistors 214 and the node between the respective electrostatic storing capacitors 118 and 119 is reduced. Furthermore, the number of second control lines 132 for controlling the turning ON and OFF of the voltage application to the source of the respective drive transistors 214 is reduced. Furthermore, the number of third control lines 134 for controlling respective Vth detection circuits which detect the threshold voltage Vth of the corresponding drive transistors 214 is reduced. Therefore, the number of outputs of the scanning/control line drive circuit 14 which outputs drive signals to these control lines is reduced, thus allowing a reduction in circuit size.

Figure 11:
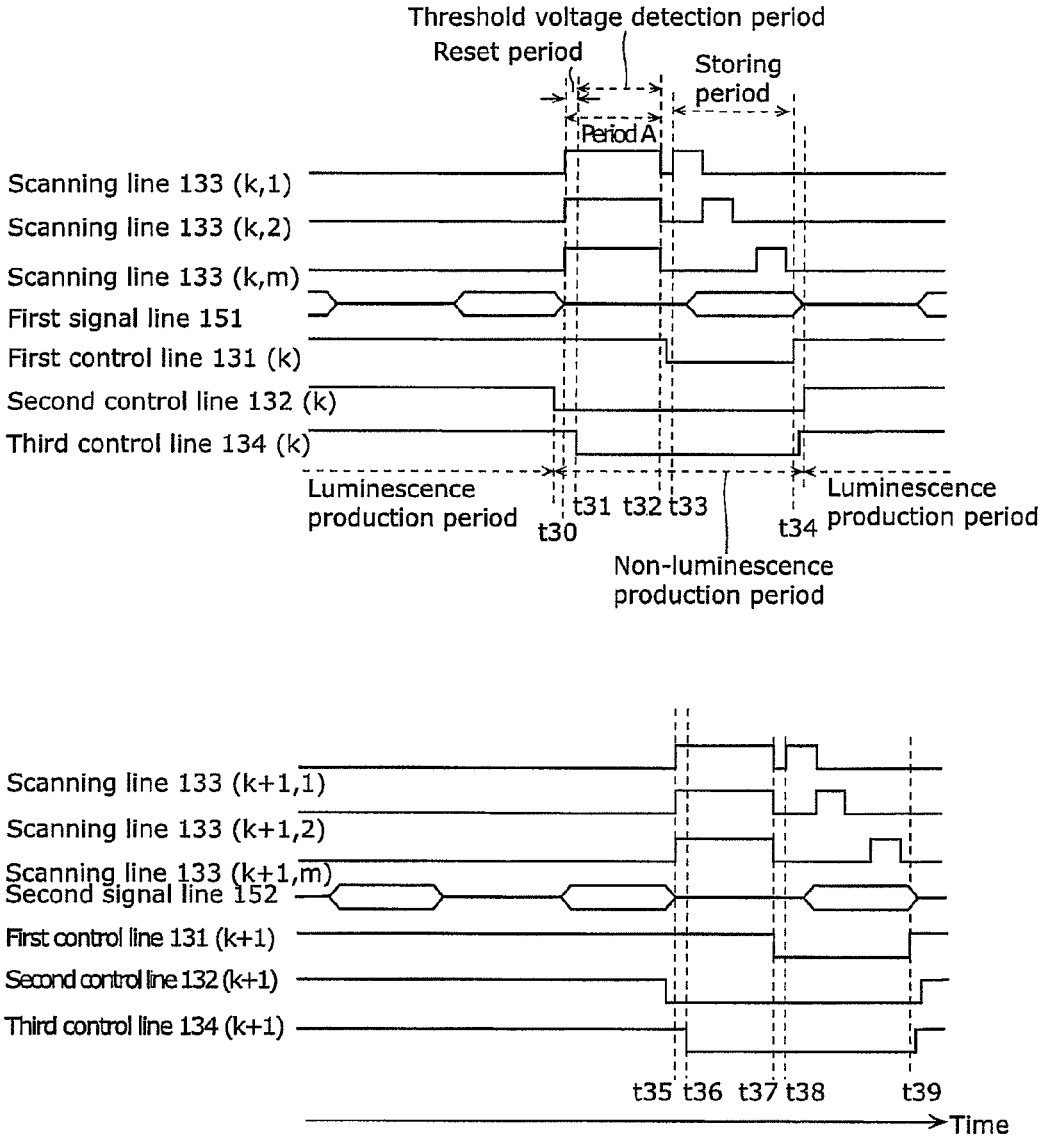
FIG. 11 is an operation timing chart for a driving method of the display device according to the third embodiment of the present invention.

Next, the driving method of the display device according to the present embodiment shall be described using FIG. 11. It should be noted that, here, the driving method of the display device including the specific circuit configuration shown in FIG. 10A and FIG. 10B shall be described in detail.

FIG. 11 is an operation timing chart for the driving method of the display device in the second embodiment of the present invention. Furthermore, FIG. 6 is an operation flowchart for the display device according to the third embodiment of the present invention.

First, immediately before the time t30, all the voltage levels of the scanning lines 133 (*k*, 1) to 133 (*k*, *m*) are LOW, and the voltage level of the second control line 132 (*k*) is also LOW.

From the moment that the voltage level of the second control line 132 (*k*) is LOW, the switching transistor 216 turns OFF. With this, the organic EL element 213 stops generating photons, and the concurrent generation of photons of the pixels in the k-th drive block ends. At the same time, the non-luminescence production period of the k-th drive block begins.

Next, at the time t30, the scanning/control line drive circuit 14 causes the voltage levels of the scanning lines 133 (*k*, 1) to 133 (*k, m*) to simultaneously change from LOW to HIGH so as to turn ON the switching transistor 215. Furthermore, at this time, the voltage level of the second control line 132 (*k*) is already at LOW and the switching transistor 216 is already OFF, and the signal line drive circuit 15 causes the signal voltage of the first signal line 151 to change from the luminance signal voltage to the reference voltage with which the drive transistor 214 turns OFF (S11 in FIG. 6). With this, all of the pixels belonging to the k-th drive block are reset through the application of the reference voltage VR to the gate of the drive transistor 214. The operation of applying the aforementioned reference voltage to the gate of the drive transistor 214 corresponds to the simultaneous applying of the reference voltage in the k-th drive block.

Next, at a time t31, the scanning/control line drive circuit 14 causes the voltage level of the third control line 134 (*k*) to change from HIGH to LOW (S12 in FIG. 6). At this time, when the voltage level of the third control line 134 (*k*) is caused to change by as much as ΔV, the potential of the second electrode of electrostatic storing capacitor 118 falls by as much as a voltage distributed according to the capacitance ratio between the electrostatic storing capacitor 118 and the electrostatic storing capacitor 119.

Through the changing of the voltage level of the third control line 134 (*k*) from HIGH to LOW, ΔV is set in advance to Vgs which is the gate-source voltage of the drive transistor 214 so that a voltage higher than the threshold voltage Vth of the drive transistor 214 is generated therein. Specifically, the potential difference generated in the electrostatic storing capacitor 118 is set to be a potential difference which allows for the detection of threshold voltage, thereby completing the preparation for the threshold voltage detection process. The above-described operation of causing the voltage level of the third control line 134 (*k*) by as much as ΔV corresponds to the simultaneous applying of the initializing voltage in the k-th drive block.

At this time, since the voltage level of the second control line 132 (*k*) is maintained at LOW, there is no supply of current from the power source line 112 to the drive transistor 214, and the discharge current corresponding to the voltage stored in the electrostatic storing capacitor 118 begins to flow to the drive transistor 214 and the organic EL element 213.

Between the time t31 and a time t32, the voltage stored in the electrostatic storing capacitor 118 becomes asymptotic to the threshold voltage Vth of the drive transistor 214, due to such discharge current.

Then, when the voltage stored in the electrostatic storing capacitor 118 becomes the threshold voltage Vth of the drive transistor 214, the discharge current stops.

It should be noted that, since the flowing discharge current for causing the voltage equivalent to the threshold voltage Vth to be stored in the electrostatic storing capacitor 118 is minute, it takes time for the voltage stored in the electrostatic storing capacitor 118 to become asymptotic to the threshold voltage Vth of the drive transistor 214 and reach the steady state. Therefore, the longer this period is, the more stable the voltage stored in the electrostatic storing capacitor 118 becomes, and by ensuring that this period is sufficiently long, voltage compensation having high-precision is realized.

As described thus far, in the period from the time t31 to the time t32, the correction of the threshold voltage Vth of the drive transistor 214 is executed simultaneously in the k-th drive block, and a voltage corresponding to the threshold voltage Vth of the drive transistor 214 is stored simultaneously in the respective electrostatic storing capacitors 118 of all the pixels 21A in the k-th drive block.

Next, at the time t32, the scanning/control line drive circuit 14 causes the voltage levels of the scanning lines 133 (*k*, 1) to 133 (*k, m*) to simultaneously change from HIGH to LOW so as to turn OFF the switching transistor 215 (S13 in FIG. 6). This completes the threshold voltage detection operation of the pixels belonging to the k-th drive block. The above-described operation of turning OFF the switching transistor 215 to stop the supply of the reference voltage to the gate of the drive transistor 214 corresponds to the simultaneous causing of the non-conduction in the k-th drive block.

The above-described simultaneous applying of the reference voltage in the k-th drive block, the simultaneous applying of the initializing voltage in the k-th drive block, and the simultaneous causing of the non-conduction in the k-th drive block correspond to the storing of the voltage (corresponding to the threshold voltage of a corresponding drive transistor) in the k-th drive block.

Next, in a period from the time t32 to a time t33, the scanning/control line drive circuit 14 causes the voltage level of the first control line 131 (*k*) to change from HIGH to LOW so as to turn OFF the switching transistor 117. This completes the preparation for storing the luminance signal voltage to the pixels belonging to the k-th drive block. Because the switching transistor 117 is OFF during the luminance signal voltage storing period, the current path between the second electrode of the electrostatic storing capacitor 118 and the source of the drive transistor 214 is blocked. Therefore, during the storing period, the discharge current from the electrostatic storing capacitor 118 to the drive transistor 214 does not flow, and an accurate voltage corresponding to the luminance signal voltage is stored in the electrostatic storing capacitor 118. Furthermore, since such period does not require high-speed storing for controlling the leak current, the ideal storing period necessary for storing an accurate luminance signal voltage can be secured.

Next, between the time t33 to a time t34, the scanning/control line drive circuit 14 causes the voltage levels of the scanning lines 133 (*k*, 1) to 133 (*k, m*) to sequentially change from LOW to HIGH to LOW so as to sequentially turn ON the switching transistors 215 on a per pixel row basis. Furthermore, at this time, the signal line drive circuit 15 causes the signal voltage of the first signal line 151 to change from the reference voltage VR to the luminance signal voltage Vdata (S14 in FIG. 6). With this, the luminance signal voltage Vdata is applied to the gate of the drive transistor 214. At this time, a summed voltage obtained by adding a voltage corresponding to this luminance signal voltage Vdata and the voltage equivalent to the previously stored threshold voltage Vth of the drive transistor 214 is stored into the electrostatic storing capacitor 118. The above-described operation of storing the summed voltage corresponds to the storing of a summed value in the k-th drive block.

As described thus far, in a period from the time t33 to the time t34, the storing of the corrected luminance signal voltage is sequentially executed in the k-th drive block on a per pixel row basis.

Next, at the time t34, the scanning/control line drive circuit 14 causes the voltage level of the first control line 131 (*k*) to change from LOW to HIGH. Furthermore, almost simultaneously, the scanning/control line drive circuit 14 causes the voltage levels of the second control line 132 (*k*) and the third control line 134 (*k*) to change from LOW to HIGH (S15 in FIG. 6). With this, a drive current corresponding to the aforementioned summed voltage flows to the organic EL element 213. In other words, generation of photons begins simultaneously in all the pixels 21A in the k-th drive block. The above-described photon generation operation corresponds to the generating of the photons in the k-th drive block.

As described above, in the period from the time when the voltage level of the second control line 132 (*k*) is caused to change from HIGH to LOW, the photon generation of the organic EL elements 113 is executed simultaneously in the k-th drive block.

As described thus far, by forming the pixel rows into drive blocks, the correction of the threshold voltage Vth of the drive transistors 214 is executed simultaneously in the respective drive blocks. Furthermore, the generation of photons by the organic EL elements 213 is executed simultaneously in the respective drive blocks. With this, the control for turning the drive current of the drive transistors 2140N and OFF can be synchronized in the respective drive blocks. Therefore, the first control line 131, the second control line 132, and the third control line 134 can be shared in each of the drive blocks.

Furthermore, although the scanning lines 133 (*k*, 1) to 133 (*k, m*) are separately connected to the scanning/control line drive circuit 14, the timing of the drive pulse in the threshold voltage compensation period is the same. Therefore, the scanning/control line drive circuit 14 can suppress the rising of the frequency of the pulse signals to be outputted, and thus the output load on the drive circuit is decreased.

From the same perspective as the first embodiment, the present embodiment also has the advantage that luminescence duty can be secured longer compared to the conventional image display device using two signal lines.

Therefore, it is possible to realize a display device that ensures sufficient luminescence luminance and has long operational life due to reduced output load on drive circuits.

Furthermore, it is understood that when the same luminescence duty is set to the conventional image display device using two signal lines and the display device combining block driving as in the present invention, the display device according to the present invention ensures a longer threshold voltage detection time.

The driving method of the display device according to the present embodiment shall be described once again.

Meanwhile, from a time t35 onward, the correction of the threshold voltage of the drive transistors 214 in the (k+1)-th drive block begins.

Since the reset operation in the period from the time 35 to a time t36, the threshold voltage correction operation in the period from the time t36 to a time t37, and the storing operation in the period from a time t38 to a time t39 for the (k+1)-th drive block are respectively the same as the reset operation in the period from the time 30 to the time t31, the threshold voltage correction operation in the period from the time t31 to the time t32, and the storing operation in the period from the time t33 to the time t34 for the k-th drive block, description thereof shall be omitted here.

According to the driving method of the display device according to third embodiment of the present invention, the luminescence production periods are concurrently set within the same drive block. Therefore, among the drive blocks, the luminescence production periods appear in a staircase pattern with respect to the row scanning direction.

As described thus far, the drive transistor 214 threshold voltage correction periods as well as the timings thereof can be made uniform within the same drive block through the pixel circuits in which the switching transistors 216 and 217 and the electrostatic storing capacitor 219 are provided, the arrangement of the control lines, scanning lines, and signal lines to the respective pixels that are formed into drive blocks, and the above-described driving method. In addition, the luminescence production periods as well as the timings thereof can be made uniform within the same drive block. Therefore, the load on the scanning/control line drive circuit 14 which outputs signals for controlling the conductive state and non-conductive state of respective switching transistors and signals for controlling current paths, and on the signal line drive circuit 15 which controls signal voltages is decreased. In addition, through the above-described forming of drive blocks and the two signal lines arranged for every pixel column, the drive transistor 214 threshold voltage correction period can take a large part of a 1 frame period Tf which is the time in which all the pixels are refreshed.

Furthermore, by forming drive blocks, the first control line for controlling the conduction between the source of the drive transistor 214 and the electrostatic storing capacitor 118, the second control line for controlling the turning ON and OFF of the voltage application to the drive transistor 214, and the third control line for controlling the potential of the second electrode of the electrostatic storing capacitor 118 can be shared within a drive block. Therefore, the number of is control lines outputted from the scanning/control line drive circuit 14 is reduced. Therefore, the load on the drive circuit is decreased.

Although the first to third embodiments have been described thus far, the display device according to the present invention is not limited to the above-described embodiments. The present invention includes other embodiments implemented through a combination of arbitrary components of the first to third embodiments, or modifications obtained through the application of various modifications to the first to third embodiments and the modifications thereto, that may be conceived by a person of ordinary skill in the art, that do not depart from the essence of the present invention, or various devices in which the display device according to the present invention is built into.

For example, the circuit configuration of the display device according to the third embodiment can be used to cause sequential generation of photons on a per pixel row basis as in the display device 1 according to the second embodiment. In this case, such sequential photon generation can be implemented by connecting the second control line 132 to the scanning/control line drive circuit 14 on a pixel row basis without sharing the second control line 132 in each of the drive blocks.

Figure 12:
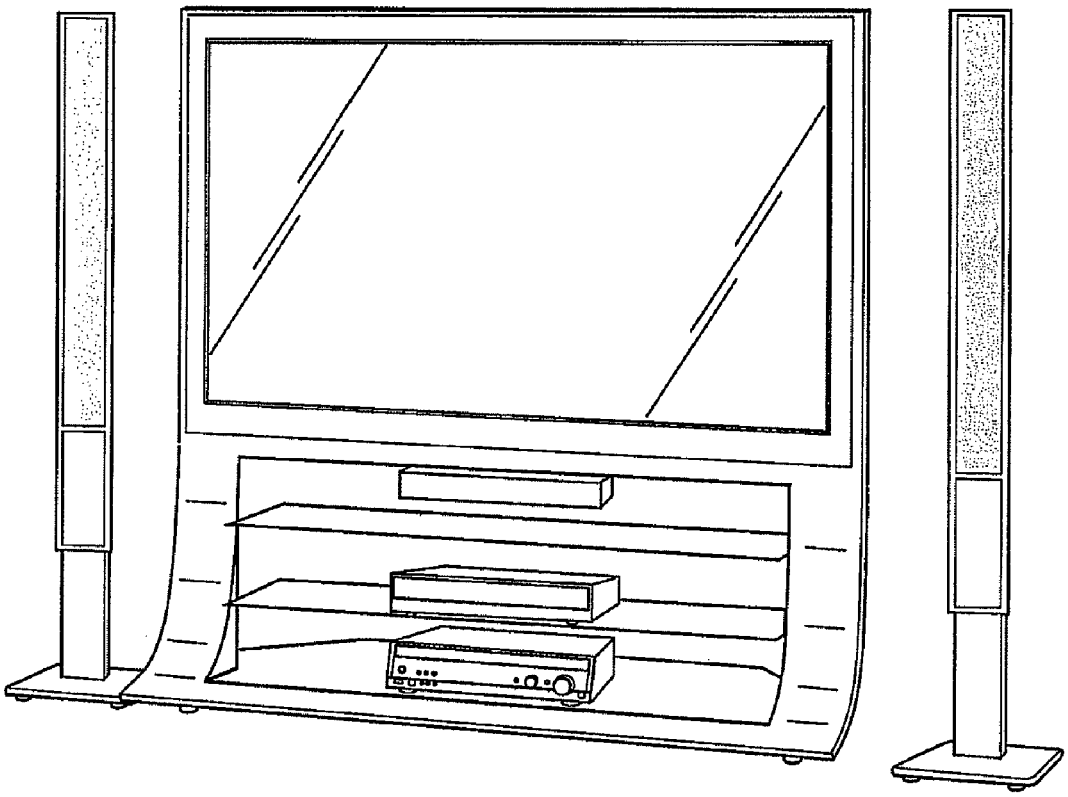
FIG. 12 is an external view of a thin flat-screen TV incorporating the display device in the present invention.
Figure 13:
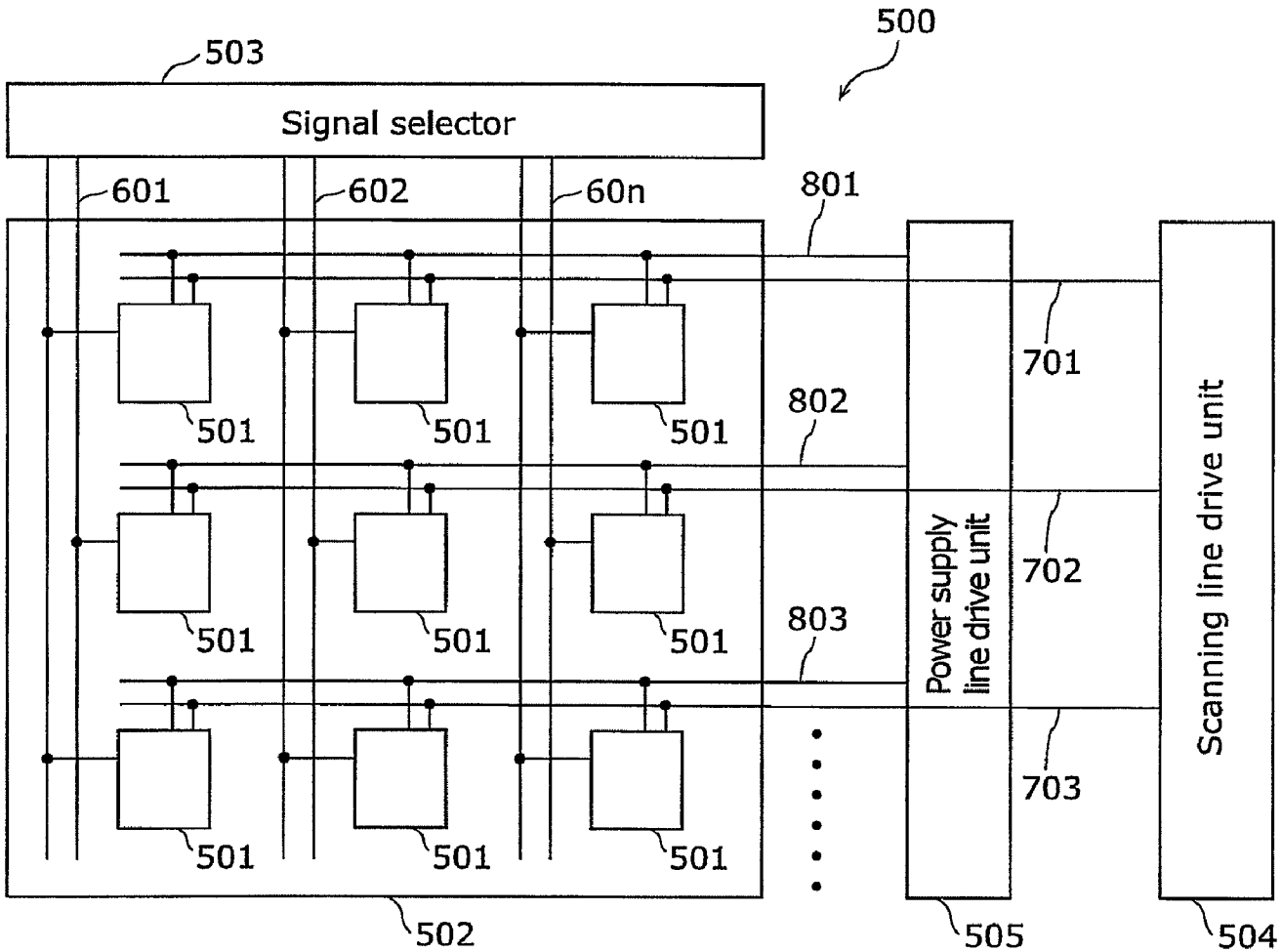
FIG. 13 is a block diagram showing the configuration of a conventional image display device disclosed in Patent Reference 1.

Furthermore, for example, the display device according to the present invention is built into a thin flat-screen TV such as that shown in FIG. 12. A thin flat-screen TV capable of high-accuracy image display reflecting a video signal is implemented by having the display device according to the present invention built into the TV.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of this invention.

Industrial Applicability

The present invention is particularly useful in an active-type organic EL flat panel display which causes luminance to fluctuate by controlling pixel photon generation intensity according to a pixel signal current.

What is claimed is:

1. A display device including pixels arranged in rows and columns, the display device comprising:

a first signal line and a second signal line which are disposed in each of the columns, for supplying the pixels with a signal voltage that determines luminance of the pixels;

a first power source line and a second power source line;

a scanning line disposed in each of the rows; and a first control line, a second control line, and a third control line which are disposed in each of the rows, wherein the pixels compose at least two driving blocks each of which includes at least two of the rows, each of the pixels includes:

a luminescence element that includes terminals, one of the terminals being connected to the second power source line, the luminescence element generating photons according to a flow of a signal current corresponding to the signal voltage;

a drive transistor that includes a source and a drain and converts the signal voltage applied between a gate and the source of the drive transistor into the signal current, one of the source and the drain being connected to the other of the terminals of the luminescence element;

a first capacitor element that includes terminals, one of the terminals being connected to the gate of the drive transistor;

a second capacitor element that includes terminals, one of the terminals being connected to the other of the terminals of the first capacitor element and the other of the terminals being connected to the third control line;

a first switching transistor that includes a gate connected to the first control line, one of a source and a drain connected to the other terminal of the first capacitor element, and the other of the source and the drain connected to the source of the drive transistor; and a second switching transistor that includes a gate connected to the second control line, and a source and a drain which are inserted between the first power source line and the other of the source and the drain of the drive transistor, each of the pixels in a k-th drive block of the drive blocks further includes a third switching transistor that includes a gate connected to the scanning line, one of a source and drain connected to the gate of the drive transistor, and the other of the source and the drain connected to the first signal line, k being a positive integer, each of the pixels in a (k+1)-th drive block of the drive blocks further includes a fourth switching transistor that includes a gate connected to the scanning line, one of a source and a drain connected to the gate of the drive transistor, and the other of the source and the drain connected to the second signal line, and the first control line and the third control line are connected to the pixels in a same one of the drive blocks and not connected to the pixels in different ones of the drive blocks.

2. The display device according to claim 1, wherein the second control line is connected to the pixels in a same one of the drive blocks and not connected to the pixels in different ones of the drive blocks.

3. The display device according to claim 1, further comprising a drive circuit which drives each of the pixels by controlling the first signal line, the second signal line, the first control line, the second control line, the third control line, and the scanning line, wherein the drive circuit:

stops applying a power source voltage to the drive transistor of each of the pixels in the k-th drive block by turning OFF the second switching transistor using a control signal from the second control line;

simultaneously applies a reference voltage from the first signal line to the gate of the drive transistor of each of the pixels in the k-th drive block by turning ON the third switching transistor using a scanning signal from the scanning line;

simultaneously applies an initializing voltage to the source of the drive transistor of each of the pixels in the k-th drive block by causing a voltage level of the third control line to change in a state in which the first switching transistor is ON, the initializing voltage causing a gate-source voltage of the drive transistor to be equal to or higher than a threshold voltage;

simultaneously causes non-conduction between the first signal line and the gate of the drive transistor of each of the pixels in the k-th drive block by turning OFF the third switching transistor using a scanning signal from the scanning line;

stops applying the power source voltage to the drive transistor of each of the pixels in the (k+1)-th drive block by turning OFF the second switching transistor using a control signal from the second control line;

simultaneously applies the reference voltage from the second signal line to the gate of the drive transistor of each of the pixels in the (k+1)-th drive block by turning ON the fourth switching transistor using a scanning signal from the scanning line;

simultaneously applies the initializing voltage to the source of the drive transistor of each of the pixels in the (k+1)-th drive block by causing a voltage level of the third control line to change in a state in which the first switching transistor is ON; and simultaneously causes non-conduction between the second signal line and the gate of the drive transistor of each of the pixels in the (k+1)-th drive block by turning OFF the fourth switching transistor using a scanning signal from the scanning line.

4. The display device according to claim 1, wherein the signal voltage includes a luminance signal voltage for causing the luminescence element to generate photons and a reference voltage for causing a voltage corresponding to a threshold voltage of the drive transistor to be stored in the first capacitor element, the display device further comprises:

a signal line drive circuit that outputs the signal voltage to the first signal line and the second signal line; and a timing control circuit that controls the timing at which the signal line drive circuit outputs the signal voltage, and the timing control circuit (i) causes the signal line drive circuit to output the reference voltage to the second signal line when the signal line drive circuit is outputting the luminance signal voltage to the first signal line, and (ii) causes the signal line drive circuit to output the reference voltage to the first signal line when the signal line drive circuit is outputting the luminance signal voltage to the second signal line.

5. The display device according to claim 1, wherein, where a period of time for refreshing all of the pixels is Tf, and a total number of the drive blocks is N, a period of time for detecting a threshold voltage of the drive transistor is at most Tf/N.

6. A method of driving a display device in which pixels are arranged in rows and columns and compose at least two drive blocks, each of the drive blocks including at least two of the rows, each of the pixels including a drive transistor and a luminescence element, the drive transistor converting one of a luminance signal voltage and a reference voltage supplied by one of signal lines into a signal current corresponding to the one of a luminance signal voltage and the reference voltage, the luminescence element generating photons according to a flow of the signal current, the method comprising:

storing a voltage corresponding to a threshold voltage of a corresponding drive transistor, simultaneously, in a first capacitor element connected to a gate of the drive transistor of each of the pixels in a k-th drive block of the drive blocks, k being a positive integer;

storing a summed voltage, in a pixel row-sequence, in the first capacitor element of each of the pixels in the k-th drive block, after the storing of the voltage in the k-th drive block, the summed voltage being obtained by adding the luminance signal voltage to the voltage corresponding to the threshold voltage; and storing a voltage corresponding to a threshold voltage of a corresponding drive transistor, simultaneously, in a first capacitor element in each of the pixels in a (k+1)-th drive block of the drive blocks, after the storing of the voltage in the k-th drive block, wherein the storing of the voltage in the k-th drive block includes:

simultaneously applying the reference voltage from a first signal line to the gate of the drive transistor of each of the pixels in the k-th drive block, the first signal line being disposed in each of the columns;

simultaneously applying an initializing voltage, from a third control line disposed in each of the rows to a source of the drive transistor of each of the pixels in the k-th drive block, after simultaneously applying the reference voltage in the k-th drive block, the initializing voltage causing a gate-source voltage of the drive transistor to be equal to or higher than a threshold voltage; and simultaneously causing non-conduction between the first signal line and the gate of the drive transistor of each of the pixels in the k-th drive block, after simultaneously applying the initializing voltage in the k-th drive block, and the storing of the voltage in the (k+1)-th drive block includes:

simultaneously applying the reference voltage from a second signal line to the gate of the drive transistor of each of the pixels in the (k+1)-th drive block, the second signal line being disposed in each of the columns and being different from the first signal line;

simultaneously applying the initializing voltage, from the third control line to a source of the drive transistor of each of the pixels in the (k+1)-th drive block, after simultaneously applying the reference voltage in the (k+1)-th drive block; and simultaneously causing non-conduction between the second signal line and the gate of the drive transistor of each of the pixels in the (k+1)-th drive block, after simultaneously applying the initializing voltage in the (k+1)-th drive block.

7. The method according to claim 6, wherein each of the pixels includes terminals, one of the terminals being connected to a second power source line and the other of the terminals being connected to one of the source or a drain of the drive transistor, in simultaneously applying the reference voltage in the k-th drive block, the reference voltage is applied from the first signal line to the gate of the drive transistor by causing conduction of a third switching transistor included in each of the pixels in the k-th drive block, the third switching transistor including (i) a gate connected to a corresponding one of scanning lines each disposed in a corresponding one of the rows, (ii) one of a source and a drain connected to the gate of the drive transistor, and (ii) the other of the source and the drain connected to the first signal line, in simultaneously applying the reference voltage in the (k+1)-th drive block, the reference voltage is applied from the second signal line to the gate of the drive transistor by causing conduction of a fourth switching transistor included in each of the pixels in the (k+1)-th drive block, the fourth switching transistor including (i) a gate connected to a corresponding one of the scanning lines, (ii) one of a source and a drain connected to the gate of the drive transistor, and (ii) the other of the source and the drain connected to the second signal line, in simultaneously applying the initializing voltage in the k-th drive block and simultaneously applying the initializing voltage in the (k+1)-th drive block, supply of power source voltage to the drive transistor is stopped by causing non-conduction of a second switching transistor, and the initializing voltage is applied from the third control line to the source of the drive transistor via a first switching transistor, in a state in which conduction of the first switching transistor is caused, the second switching transistor including (i) a gate connected to a second control line disposed in each of the rows, and (ii) a source and a drain which are inserted between a first power source line and the other of the source and the drain of the drive transistor, and the first switching transistor including (i) a gate connected to a first control line disposed in each of the rows, (ii) one of a source and a drain connected to the other of terminals of the first capacitor element, and (iii) the other of the source and the drain connected to the source of the drive transistor, in simultaneously causing the non-conduction of the k-th drive block, the non-conduction is caused between the first signal line and the gate of the drive transistor, by causing non-conduction of the third switching transistor, in simultaneously causing the non-conduction of the (k+1)-th drive block, the non-conduction is caused between the second signal line and the gate of the drive transistor, by causing non-conduction of the fourth switching transistor, and in the storing of the summed voltage in the k-th drive block, the luminance signal voltage is applied from the first signal line to the gate of the drive transistor, by causing non-conduction of the third switching transistor.

8. The method according to claim 6, further comprising generating the photons by simultaneously supplying the signal current, as a drain current of the drive transistor, to the luminescence element of each of the pixels in the k-th drive block, after the storing of the summed voltage in the k-th drive block.

9. The method according to claim 6, further comprising:

storing a summed voltage, in the pixel row-sequence, in the first capacitor element of each of the pixels in the (k+1)-th drive block, after the storing of the voltage in the (k+1)-th drive block, the summed voltage being obtained by adding the luminance signal voltage to the voltage corresponding to the threshold voltage; and generating the photons by simultaneously supplying the signal current, as the drain current of the drive transistor, to the luminescence element of each of the pixels in the (k+1)-th drive block, after the storing of the summed voltage in the (k+1)-th drive block.

* * * * *